US011680729B2

(12) United States Patent
Niimura

(10) Patent No.: US 11,680,729 B2
(45) Date of Patent: Jun. 20, 2023

(54) WIND DIRECTION ADJUSTMENT MECHANISM, INDOOR UNIT OF AIR-CONDITIONING APPARATUS, AND AIR-CONDITIONING APPARATUS

(71) Applicant: Mitsubishi Electric Corporation, Tokyo (JP)

(72) Inventor: Takuya Niimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 503 days.

(21) Appl. No.: 16/976,532

(22) PCT Filed: Apr. 24, 2018

(86) PCT No.: PCT/JP2018/016673
§ 371 (c)(1),
(2) Date: Aug. 28, 2020

(87) PCT Pub. No.: WO2019/207659
PCT Pub. Date: Oct. 31, 2019

(65) Prior Publication Data
US 2020/0408438 A1 Dec. 31, 2020

(51) Int. Cl.
*F24F 13/15* (2006.01)
*F24F 1/0011* (2019.01)
*F24F 1/0025* (2019.01)

(52) U.S. Cl.
CPC ..... *F24F 13/15* (2013.01); *F24F 1/0011* (2013.01); *F24F 1/0025* (2013.01)

(58) Field of Classification Search
CPC ..... F24F 13/15; F24F 1/0011; F24F 1/0025
(Continued)

(56) References Cited

FOREIGN PATENT DOCUMENTS

JP 2007-120890 A 5/2007
JP 2012-149784 A 8/2012
JP 2014119176 A * 6/2014

OTHER PUBLICATIONS

JP-2014119176-A English Abstract (Year: 2014).*
(Continued)

*Primary Examiner* — Steven B McAllister
*Assistant Examiner* — Charles R Brawner
(74) *Attorney, Agent, or Firm* — Posz Law Group, PLC

(57) ABSTRACT

A wind direction adjustment mechanism includes: a support plate having a holding protrusion; a fixed plate fixed to a surface portion of the support plate; a movable plate facing the surface portion of the support plate, and slidably held by the support plate; and a plurality of wind direction plates formed of an elastic material, and provided to extend between the fixed plate and the movable plate, wherein the movable plate has an angle holding portion into which the holding protrusion is inserted to maintain a sliding position of the movable plate, the angle holding portion includes a side wall portion and a plurality of partition wall portions, the side wall portion protruding in a direction opposite to a direction toward a portion where the support plate is disposed, thus forming a frame structure, the plurality of partition wall portions being formed in parallel, each of the plurality of partition wall portions is formed such that an angle adjustment portion and an angle restricting portion are integrally formed, the angle restricting portion coupling to the angle adjustment portion, and being formed to have a larger wall thickness than the angle adjustment portion, the movable plate is biased, by an elastic restoring force of the plurality of wind direction plates, in a direction opposite to a direction toward a portion where the fixed plate is disposed, the holding protrusion is disposed in a space surrounded by the plurality of partition wall portions and the
(Continued)

side wall portion, and the angle restricting portion comes into contact with the holding protrusion.

16 Claims, 15 Drawing Sheets

(58) Field of Classification Search
USPC ..... 454/233
See application file for complete search history.

(56) References Cited

OTHER PUBLICATIONS

International Search Report of the International Searching Authority dated Jul. 31, 2018 for the corresponding international application No. PCT/JP2018/016673 (and English translation).
Extended European Search Report dated Mar. 12, 2021, issued in corresponding European Patent Application No. 18916409.8.

* cited by examiner

WIND DIRECTION ADJUSTMENT MECHANISM, INDOOR UNIT OF AIR-CONDITIONING APPARATUS, AND AIR-CONDITIONING APPARATUS

CROSS REFERENCE TO RELATED APPLICATION

This application is a U.S. national stage application of PCT/JP2018/016673 filed on Apr. 24, 2018, the contents of which are incorporated herein by reference.

TECHNICAL FIELD

The present disclosure relates to a wind direction adjustment mechanism configured to determine the blowing direction of conditioned air, an indoor unit of an air-conditioning apparatus provided with the wind direction adjustment mechanism, and an air-conditioning apparatus provided with this indoor unit.

BACKGROUND ART

The indoor unit of a related-art air-conditioning apparatus is provided with a wind direction adjustment mechanism configured to determine the blowing direction of conditioned air blown out into a room from the indoor unit. For example, for a wind direction adjustment mechanism of an indoor unit of an air-conditioning apparatus for adjusting a wind direction in the horizontal direction (left-and-right direction), a wind direction adjustment mechanism is proposed where a protrusion provided to an air passage forming part is fitted in one of a plurality of recessed portions formed on a manipulation portion of a lateral wind direction adjustment part to hold the angle of wind direction plates (see Patent Literature 1). In the wind direction adjustment mechanism of Patent Literature 1, when the manipulation portion is pushed toward the protrusion portion, a first elastic deformation portion is deformed, so that the edge portion of an engagement portion disposed at a portion close to the manipulation portion is moved whereby an interval increases between an edge portion of the engagement portion disposed at a portion close to a coupling portion and the edge portion of the engagement portion disposed at a portion close to the manipulation portion. Therefore, the wind direction adjustment mechanism of Patent Literature 1 allows the protrusion portion to be easily moved in the engagement portion.

CITATION LIST

Patent Literature

Patent Literature 1: Japanese Unexamined Patent Application Publication No. 2012-149784

SUMMARY OF INVENTION

Technical Problem

In the wind direction adjustment mechanism of Patent Literature 1, when the wind direction plates are inclined at a large angle, the protrusion portion provided to the air passage forming part is fitted in a recessed portion positioned at an end portion out of the plurality of arranged recessed portions in a direction along which the recessed portions are arranged. In this case, a thin wall portion of each wind direction plate is significantly twisted, so that a large elastic restoring force of the wind direction plates is applied to the protrusion portion via the manipulation portion. Therefore, in the wind direction adjustment mechanism of Patent Literature 1, when the wind direction plates are inclined at a large angle, due to the elastic restoring force of the wind direction plates, the recessed portion of the manipulation portion passes over the protrusion portion and moves in the left-and-right direction, so that the angle of the wind direction plates may be changed. Further, in the wind direction adjustment mechanism of Patent Literature 1, in order to prevent unintentional change in the angle of the wind direction plates during the usage of the air-conditioning apparatus, it is necessary to increase a force of the protrusion portion to hold the manipulation portion, for example, it is necessary to enlarge the shape of the recessed portion, so that a user may be required to apply an additional force for manipulation of the manipulation portion.

The present disclosure has been made to overcome the above-mentioned problem, and it is an object of the present disclosure to provide a wind direction adjustment mechanism, an indoor unit of an air-conditioning apparatus, and an air-conditioning apparatus where the angle of the wind direction plates can be held with certainty, and manipulation can be easily performed when the angle of the wind direction plates is changed.

Solution to Problem

A wind direction adjustment mechanism according to one embodiment of the present disclosure is a wind direction adjustment mechanism disposed in an air supply path connecting a fan and an air outlet, the fan being disposed in an indoor unit of an air-conditioning apparatus, a housing of the indoor unit having the air outlet, the wind direction adjustment mechanism including: a support plate configured to form a part of the air supply path of the indoor unit, and having a holding protrusion protruding from a surface portion of the support plate; a fixed plate fixed to the surface portion of the support plate; a movable plate configured to face the surface portion of the support plate, the movable plate being slidably held by the support plate; and a plurality of wind direction plates made of an elastic material, provided to extend between the fixed plate and the movable plate, and protruding in a direction opposite to a direction toward a portion where the support plate is disposed, the plurality of wind direction plates being arranged in parallel, wherein the movable plate includes an angle holding portion into which the holding protrusion is inserted to maintain a sliding position of the movable plate, the angle holding portion includes: a side wall portion including a far side wall portion and a front side wall portion, and protruding in the direction opposite to the direction toward the portion where the support plate is disposed, thus forming a frame structure, the far side wall portion facing a portion where the fixed plate is disposed, the front side wall portion being disposed on a side opposite to the far side wall portion; and a plurality of partition wall portions configured to couple the far side wall portion and the front side wall portion to each other, the plurality of partition wall portions being formed in parallel, each of the plurality of partition wall portions is formed such that an angle adjustment portion and an angle restricting portion are integrally formed, the angle adjustment portion protruding from the front side wall portion in a direction toward a portion where the far side wall portion is disposed, the angle restricting portion protruding from the far side wall portion in a direction toward a portion where the front side wall portion is disposed, coupling to the angle adjustment portion, and being formed to have a larger wall thickness than the angle adjustment portion in a direction perpendicular to a plate surface of the movable plate, and in a state where the fixed plate and the movable plate are disposed on the support plate, the movable plate is biased, by an elastic restoring force of the plurality of wind direction plates, in a direction opposite to a direction toward the portion where the fixed plate is disposed, the holding protrusion is disposed in a space surrounded by the plurality of partition wall portions and the side wall portion, and the angle restricting portion comes into contact with the holding protrusion.

Advantageous Effects of Invention

In the wind direction adjustment mechanism according to the embodiment of the present disclosure, in the state where the fixed plate and the movable plate are disposed on the support plate, the movable plate is biased, by the elastic restoring force of the wind direction plates, in the direction opposite to the direction toward the portion where the fixed plate is disposed. The holding protrusion is disposed in the space surrounded by the partition wall portions and the side wall portion, thus restricting the movement of the movable plate in the direction opposite to the direction toward the portion where the fixed plate is disposed. Further, the angle restricting portions come into contact with the holding protrusion to restrict the movement of the movable plate in the left-and-right direction. Therefore, the wind direction adjustment mechanism can hold the angle of the wind direction plates with certainty. Further, the angle adjustment portion and the angle restricting portion of each partition wall portion are integrally formed. The angle adjustment portion protrudes from the front side wall portion toward the far side wall portion, and the angle restricting portion protrudes from the far side wall portion toward the front side wall portion, and couples to the angle adjustment portion. This angle restricting portion is formed to have a larger wall thickness than the angle adjustment portion in a direction perpendicular to the plate surface of the movable plate. That is, the angle adjustment portion is formed to have a smaller wall thickness than the angle restricting portion in the direction perpendicular to the movable plate. When a user moves the movable plate, the angle adjustment portion can pass over the holding protrusion, thus realizing easy manipulation when the angle of the wind direction plates is changed.

DESCRIPTION OF EMBODIMENTS

Hereinafter, wind direction adjustment mechanisms 30 according to an embodiment of the present disclosure, an indoor unit 100 of an air-conditioning apparatus provided with the wind direction adjustment mechanisms 30, and an air-conditioning apparatus 200 provided with this indoor unit 100 will be described with reference to drawings. In the following drawings including FIG. 1, the relative size relationships, shapes and other aspects of respective components may differ from those of actual components. In the following drawings, components given the same symbols are the same or corresponding components, and the same goes for the entire description herein. Further, terms indicating directions (for example "up", "down", "right", "left", "front", "rear" and the like) are used when necessary to facilitate the understanding. However, such terms are used merely for the sake of convenience of the description, and do not limit the arrangement and direction of an apparatus or components.

Embodiment 1

[Indoor Unit 100]

Figure 1:
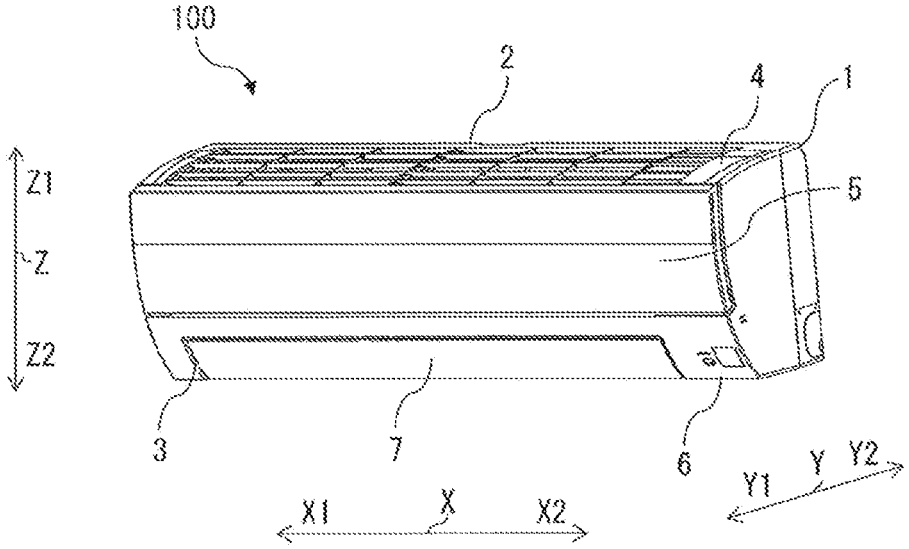
FIG. 1 is a perspective view of an indoor unit provided with wind direction adjustment mechanisms according to Embodiment 1 of the present disclosure.

FIG. 1 is a perspective view of the indoor unit 100 provided with the wind direction adjustment mechanisms 30 according to Embodiment 1 of the present disclosure. An X axis shown in the following drawings including FIG. 1 shows the width direction of the indoor unit 100, a Y axis shows the depth direction or the front-and-rear direction of the indoor unit 100, and a Z axis shows the vertical direction of the indoor unit 100. To be more specific, the indoor unit 100 will be described on the assumption that, when the indoor unit 100 is viewed from the front, an X1 side is a left side and an X2 side is a right side and a Y1 side of the Y axis is a front side and a Y2 side of the Y axis is a rear side, and a Z1 side of the Z axis is an upper side and a Z2 side of the Z axis is a lower side. The positional relationship (for example, the vertical relationship or other relationships) of respective components herein is, in principle, for the indoor unit 100 installed in a usable state.

The indoor unit 100 of an air-conditioning apparatus supplies conditioned air to an air-conditioned space, such as a room, by utilizing a refrigeration cycle that circulates refrigerant. This indoor unit 100 includes a housing 1 having an air inlet 2 and an air outlet 3. The air inlet 2 is provided for suctioning indoor air into the housing 1. The air outlet 3 is provided for supplying conditioned air to an area to be air conditioned. The housing 1 is configured such that an upper surface portion 4 of the housing 1 has the air inlet 2, and the air outlet 3 is formed on a lower position than the air inlet 2. The indoor unit 100 has the air outlet 3 formed on a lower portion of a front surface portion 5 of the housing 1, the lower portion being positioned on the front side of a lower surface portion 6 of the housing 1. A vertical flap 7 is disposed at the air outlet 3. The vertical flap 7 opens/closes the air outlet 3, and adjusts the blowing direction of air conditioned by a heat exchanger 12 described later (hereinafter, referred to as "conditioned air"). This vertical flap 7 adjusts the blowing direction of conditioned air in the vertical direction (Z axis direction).

Figure 2:
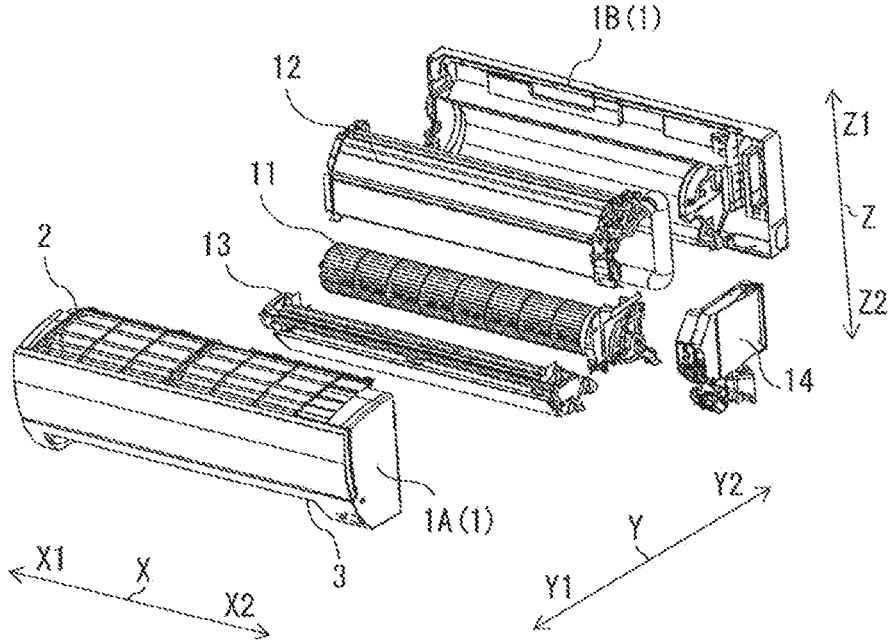
FIG. 2 is an exploded perspective view of the indoor unit shown in FIG. 1.
Figure 3:
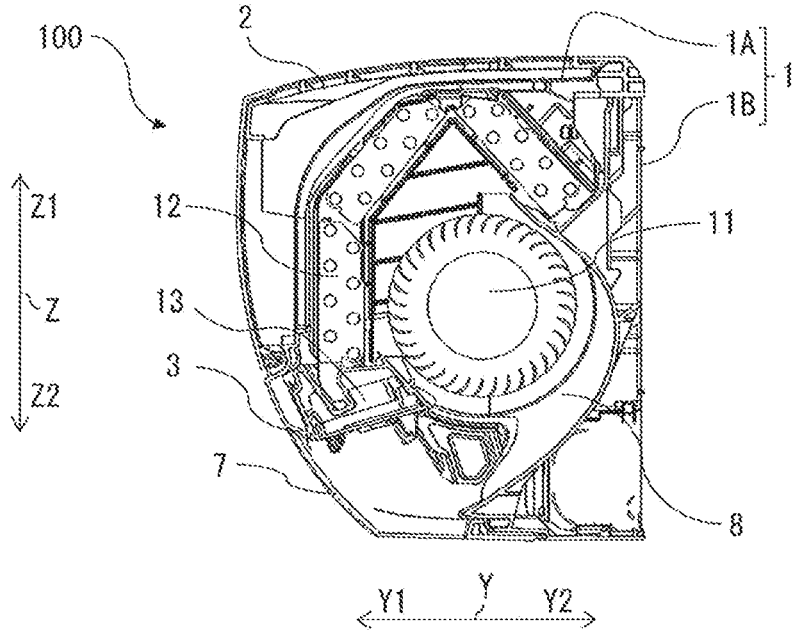
FIG. 3 is a cross-sectional view of the indoor unit shown in FIG. 1.

FIG. 2 is an exploded perspective view of the indoor unit 100 shown in FIG. 1. FIG. 3 is a cross-sectional view of the indoor unit 100 shown in FIG. 1. The configuration in the inside of the housing 1 forming the indoor unit 100 will be described with reference to FIG. 2 and FIG. 3. The housing 1 includes a front housing 1A and a base 1B. The front housing 1A has the air inlet 2 and the air outlet 3. The base 1B is attached to a wall surface in a room. The indoor unit 100 includes a fan 11 accommodated in this housing 1. The fan 11 suctions indoor air from the air inlet 2, and blows out conditioned air from the air outlet 3 to form an air path 8 extending from the air inlet 2 to the air outlet 3. The indoor unit 100 also includes the heat exchanger 12 disposed in the air path 8, extending from the air inlet 2 to the air outlet 3, in the housing 1. The heat exchanger 12 causes heat exchange to be performed between indoor air and refrigerant flowing through the heat exchanger 12 to produce conditioned air. The fan 11 and the heat exchanger 12 are disposed, in the housing 1, at positions on the downstream side of the air inlet 2 in a direction along which air flows, and on the upstream side of the air outlet 3 in the direction along which air flows.

The indoor unit 100 includes a drain pit 13 disposed below the heat exchanger 12 in the housing 1 to receive drain water dripping from the heat exchanger 12. The indoor unit 100 also includes an electric component box 14 accommodating control equipment that controls the fan 11, the heat exchanger 12, and the vertical flap 7. This electric component box 14 is disposed on the base 1B.

Figure 4:
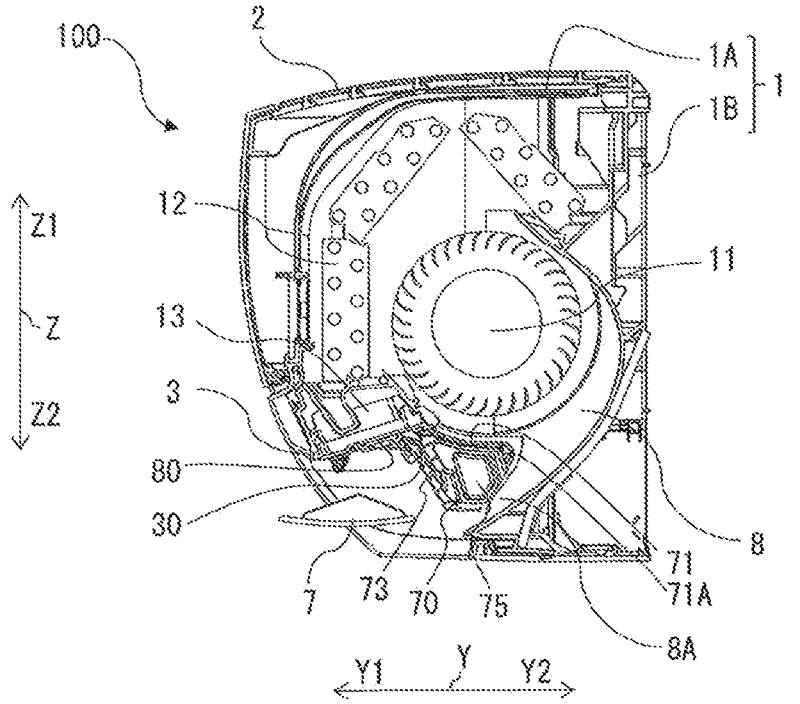
FIG. 4 is a schematic view of the indoor unit shown in FIG. 3 where a vertical flap is in an open state.
Figure 5:
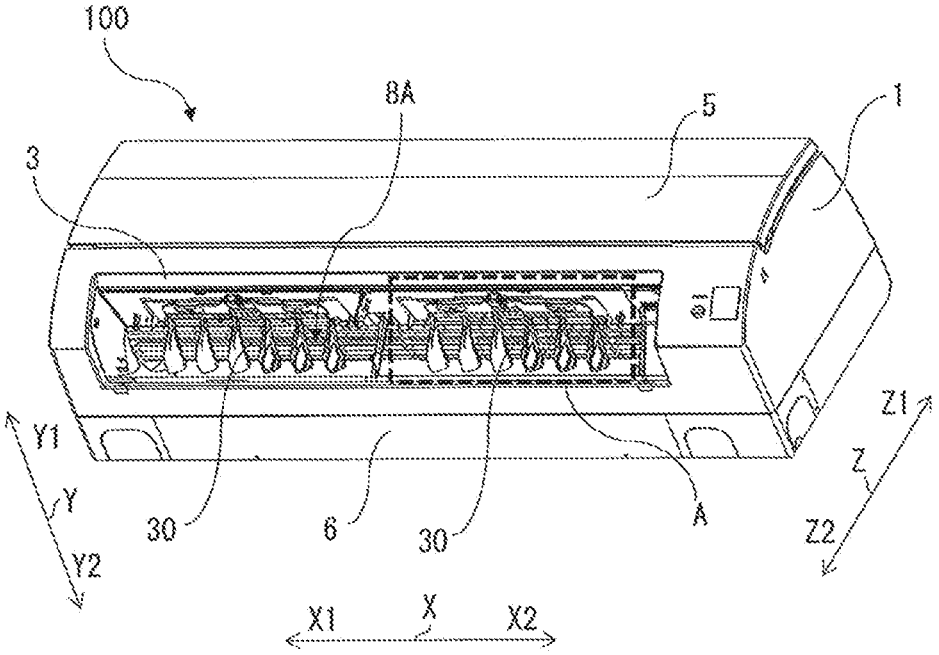
FIG. 5 is a lower perspective view of the indoor unit shown in FIG. 1.

FIG. 4 is a schematic view of the indoor unit 100 shown in FIG. 3 where the vertical flap 7 is in an open state. FIG. 5 is a lower perspective view of the indoor unit 100 shown in FIG. 1. In FIG. 5, the illustration of the vertical flap 7 is omitted to show the structure in the housing 1. As shown in FIG. 4 and FIG. 5, the indoor unit 100 includes the wind direction adjustment mechanisms 30 disposed in an air supply path 8A connecting the fan 11 and the air outlet 3, the fan 11 being disposed in the indoor unit 100, the housing 1 of the indoor unit 100 having the air outlet 3.

[Wind Direction Adjustment Mechanism 30]

The wind direction adjustment mechanism 30 adjusts the blowing direction of conditioned air in a left-and-right direction (X axis direction). Each wind direction adjustment mechanism 30 is disposed on the lower surface of the drain pit 13 at a position upstream of the air outlet 3 in the air supply path 8A. As shown in FIG. 5, two wind direction adjustment mechanisms 30 are disposed in the housing 1 in parallel in the left-and-right direction (X axis direction) of the housing 1. The number of wind direction adjustment mechanisms 30 disposed in the housing 1 of the indoor unit 100 is not limited to two, and may be one or three or more.

Figure 6:
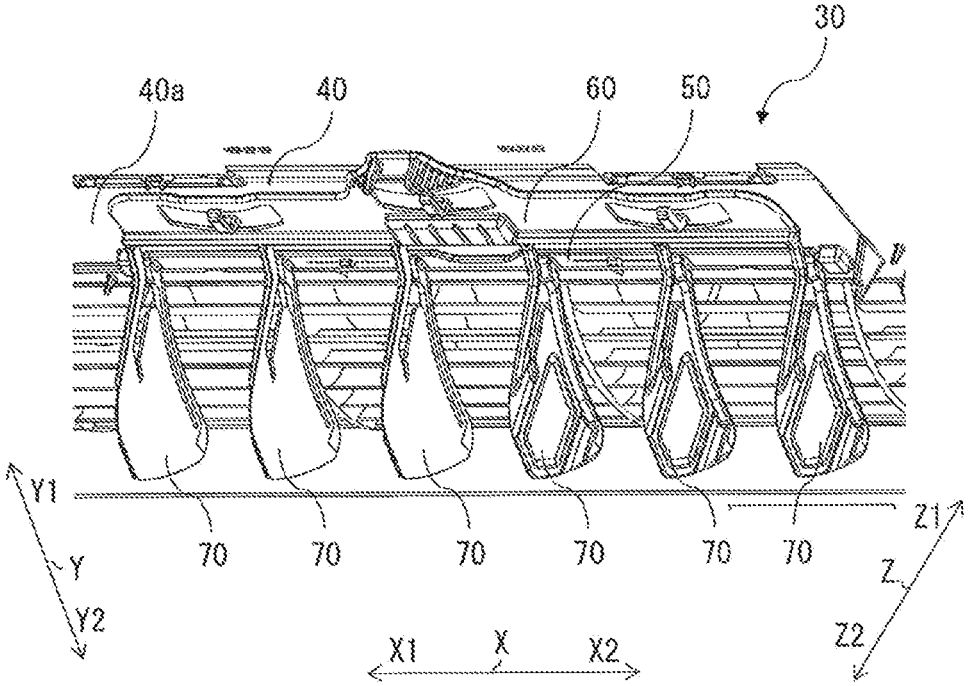
FIG. 6 is an enlarged view of a portion A of the wind direction adjustment mechanism shown in FIG. 5.

FIG. 6 is an enlarged view of a portion A of the wind direction adjustment mechanism 30 shown in FIG. 5. The wind direction adjustment mechanism 30 includes a support plate 40, a fixed plate 50, and a movable plate 60. The support plate 40 forms a portion of the air supply path 8A in the indoor unit 100. The fixed plate 50 is fixed to a surface portion 40*a* of the support plate 40. The movable plate 60 faces the surface portion 40*a* of the support plate 40, and is slidably held by the support plate 40. The wind direction adjustment mechanism 30 also includes a plurality of wind direction plates 70 each of which is made of an elastic material, and is provided to extend between the fixed plate 50 and the movable plate 60. The plurality of wind direction plates 70 protrude in a direction opposite to the direction toward the portion where the support plate 40 is disposed, and the plurality of wind direction plates 70 are arranged in parallel.

(Support Plate 40)

Figure 7:
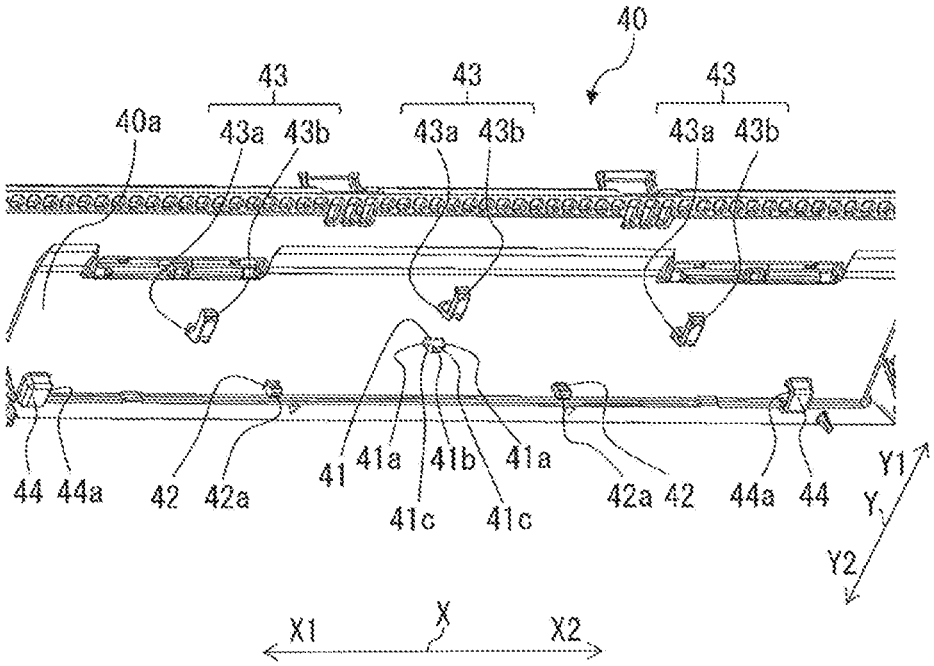
FIG. 7 is a perspective view of a support plate shown in FIG. 6.

FIG. 7 is a perspective view of the support plate 40 shown in FIG. 6. The support plate 40 is a rectangular flat-plate-like part, and is disposed on the lower surface of the drain pit 13 to form a portion of the air supply path 8A. The support plate 40 has a holding protrusion 41 formed at a center portion in the long side direction (X axis direction), the holding protrusion 41 protruding from the surface portion 40*a*. The holding protrusion 41 is formed into a cubic shape. The holding protrusion 41 is required to ensure strength in the left-and-right direction (X axis direction) to restrict the movement of the movable plate 60 in the left-and-right direction (X axis direction) caused by the elastic force of the wind direction plates 70. Therefore, it is desirable that, as viewed in a plan view from a direction perpendicular to the plate surface of the support plate 40, the length of the holding protrusion 41 in the left-and-right direction (X axis direction) is greater than the length of the holding protrusion 41 in the front-and-rear direction (Y axis direction). Side surface portions 41*a* of the holding protrusion 41 in the left-and-right direction (X axis direction) come into contact with angle restricting portions 83*b* of partition wall portions 83 of the movable plate 60 described later to restrict the movement of the movable plate 60. Further, the holding protrusion 41 has connecting portions 41*c* each of which is formed between a top surface portion 41*b* in the protruding direction and the side surface portion 41*a* of the holding protrusion 41 in the left-and-right direction (X axis direction), the connecting portions 41*c* being chamfered. The corner portions of the holding protrusion 41 are chamfered and hence, when a user moves the movable plate 60 to cause the movable plate 60 to pass over an angle adjustment portion 83*a* of the partition wall portion 83 described later, the user is allowed to easily perform manipulation whereby smooth manipulation can be realized.

The support plate 40 has fixing portions 42 and holding portions 43. Each fixing portion 42 protrudes from the surface portion 40*a*, and engages with the fixed plate 50. Each holding portion 43 protrudes from the surface portion 40*a*, and slidably holds the movable plate 60. The fixing portions 42 are disposed behind the holding protrusion 41 in the front-and-rear direction (Y axis direction) in a state where the support plate 40 is attached to the inside of the housing 1. A distal end portion 42*a* of each fixing portion 42 is formed into a wedge shape. When the fixing portions 42 are inserted into through holes formed in the fixed plate 50, the support plate 40 and the fixed plate 50 are engaged with each other, so that the fixed plate 50 is fixed to the support plate 40. Two fixing portions 42 are disposed on the support plate 40 in parallel in the long side direction (X axis direction) of the support plate 40. The number of fixing portions 42 formed on the support plate 40 is not limited to two, and may be one or three or more.

As shown in FIG. 7, insertion portions 44 are formed on an extension of a line along which the two fixing portions 42 are disposed. The insertion portion 44 is formed outward of each of the two fixing portions 42 in the long side direction (X axis direction) of the support plate 40. Each insertion portion 44 is formed into a cuboid box shape. Each of the two insertion portions 44 has an opening port 44*a* formed at a side thereof facing the other insertion portion 44. A protruding end portion 51 of the fixed plate 50 described later is inserted into this opening port 44*a* of the insertion portion 44. The insertion portions 44 hold the fixed plate 50, and restrict the movement of the fixed plate 50 in the left-and-right direction (X axis direction).

As shown in FIG. 7, each holding portion 43 includes a columnar portion 43*a* and a support portion 43*b*, and is formed into a hook shape, the columnar portion 43*a* protruding from the support plate 40, the support portion 43*b* being formed to protrude from the distal end of the columnar portion 43*a* in a forward direction (toward a Y1 side) of the housing 1. Three holding portions 43 are formed on the support plate 40. One holding portion 43 is formed at the center portion of the support plate 40 in the long side direction (X axis direction), and two holding portions 43 are respectively formed on both sides of the holding portion 43 formed at the center portion in the left-and-right direction (X axis direction). The holding portion 43 formed at the center is formed to be positioned close to the front side (Y1 side) of the housing 1 relative to the holding protrusion 41. Further, the three holding portions 43 are formed such that, as viewed in a plan view from a direction perpendicular to the plate surface of the support plate 40, the holding portion 43 positioned at the center is positioned on the front side (Y1 side) of the housing 1 compared to the other two holding portions 43. The holding portions 43 are inserted into through holes formed in the movable plate 60, and the support portions 43*b* hold the movable plate 60.

Figure 8:
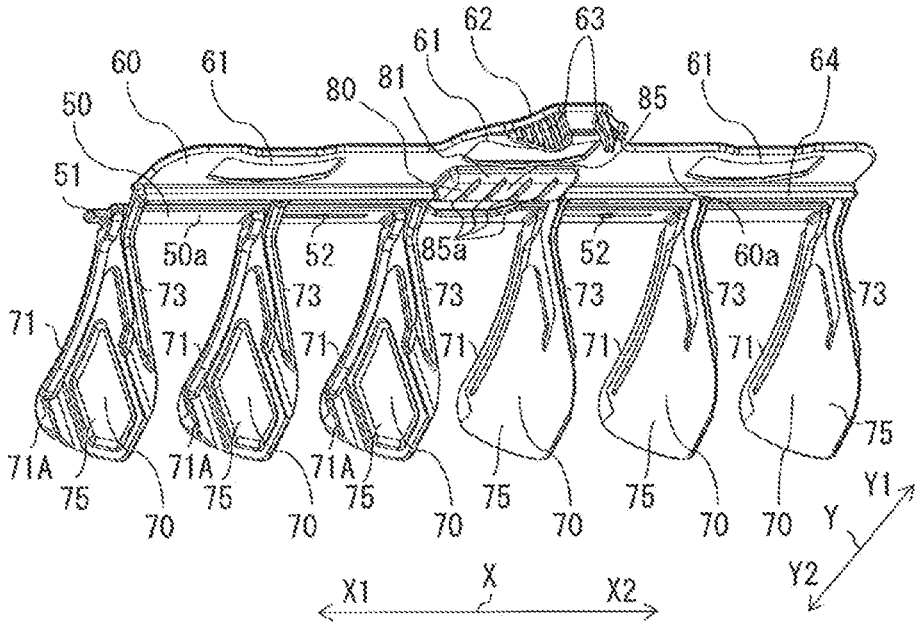
FIG. 8 is a perspective view of a fixed plate, a movable plate, and wind direction plates shown in FIG. 6.
Figure 9:
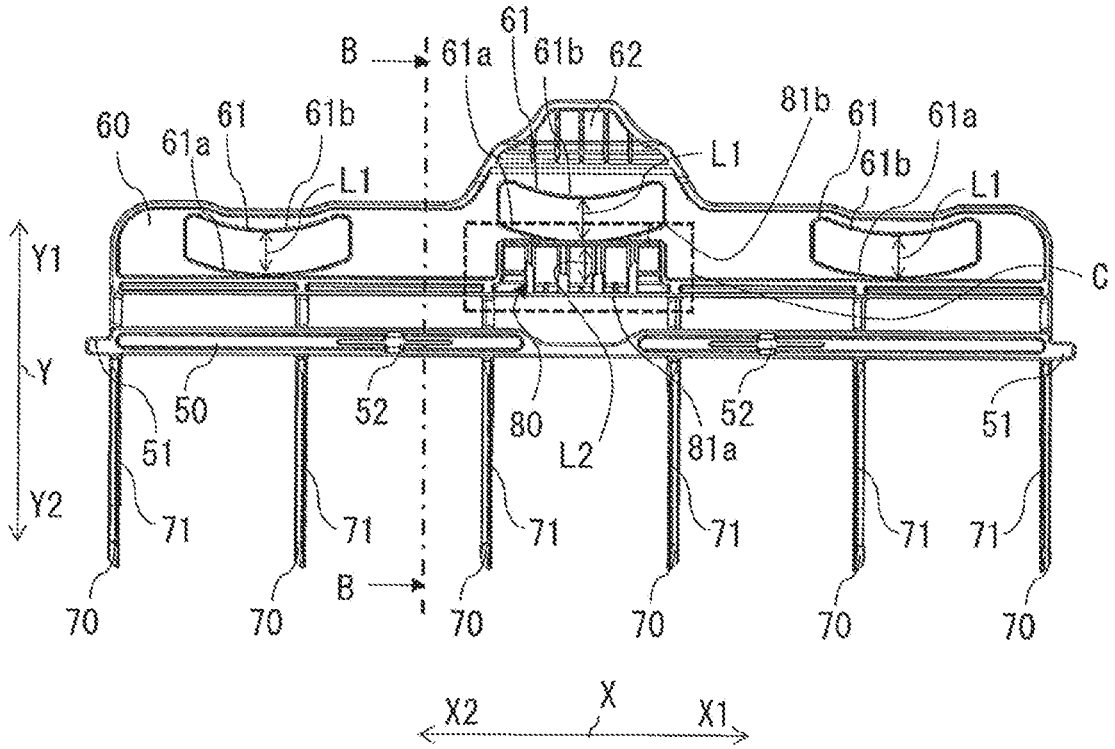
FIG. 9 is a plan view of the fixed plate, the movable plate, and the wind direction plates shown in FIG. 6 as viewed in a direction from the support plate.
Figure 10:
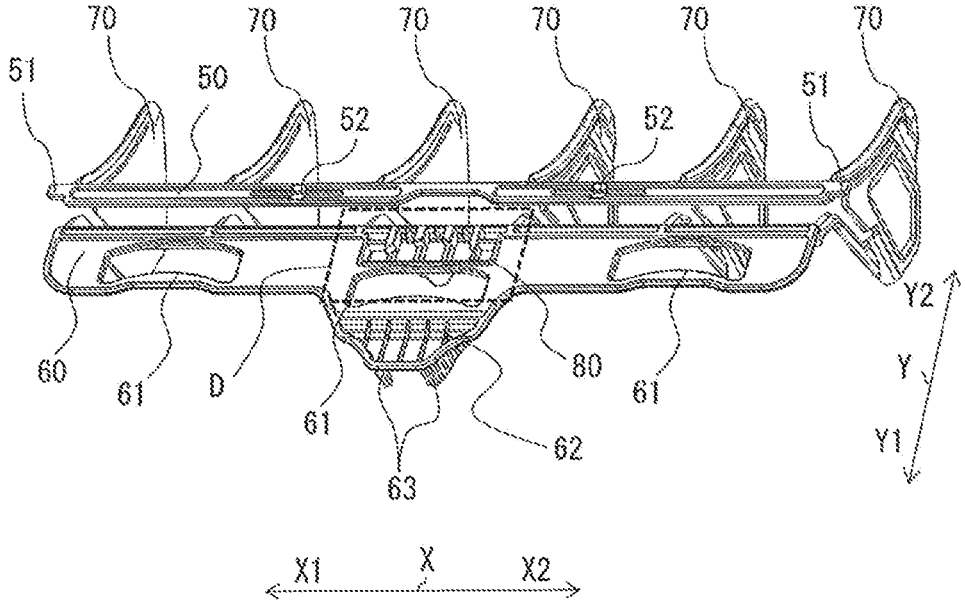
FIG. 10 is a perspective view of the fixed plate, the movable plate, and the wind direction plates shown in FIG. 6 as viewed in the direction from the support plate.

FIG. 8 is a perspective view of the fixed plate 50, the movable plate 60, and the wind direction plates 70 shown in FIG. 6. FIG. 9 is a plan view of the fixed plate 50, the movable plate 60, and the wind direction plates 70 shown in FIG. 6 as viewed in a direction from the support plate 40. FIG. 10 is a perspective view of the fixed plate 50, the movable plate 60, and the wind direction plates 70 shown in FIG. 6 as viewed in the direction from the support plate. Next, the respective configurations of the fixed plate 50, the movable plate 60, and the wind direction plates 70 will be described with reference to FIG. 8 and FIG. 9. The fixed plate 50, the movable plate 60, and the wind direction plates 70 are integrally formed. The fixed plate 50, the movable plate 60, and the wind direction plates 70 are made of an elastic material. The elastic material may be polypropylene (PP), for example.

(Fixed Plate 50)

As shown in FIG. 8 to FIG. 10, the fixed plate 50 is an elongated plate-like part. The fixed plate 50 has the plate-like protruding end portions 51 respectively formed on both end portions of the fixed plate 50 in the long side direction (X axis direction), the protruding end portions 51 protruding in the long side direction (X axis direction) of the fixed plate 50. The fixed plate 50 also has fixing-side through holes 52 into which the fixing portions 42 formed on the support plate 40 are inserted. The fixing-side through holes 52 are holes penetrating the fixed plate 50. When the protruding end portions 51 are inserted into the insertion portions 44 formed on the support plate 40, and the fixing portions 42 formed on the support plate 40 are inserted into the fixing-side through holes 52, the fixed plate 50 is fixed to the surface portion 40*a* of the support plate 40.

(Movable Plate 60)

As shown in FIG. 8 to FIG. 10, the movable plate 60 is a plate-like part having a large length where the length of the movable plate 60 in the long side direction (X axis direction) is substantially equal to that of the fixed plate 50, and the length of the movable plate 60 in the short side direction (Y axis direction) is larger than that of the fixed plate 50, so that the movable plate 60 has a large width. The movable plate 60 includes an angle holding portion 80 formed at the center portion of the movable plate 60 in the long side direction (X axis direction). The holding protrusion 41 formed on the support plate 40 is inserted into the angle holding portion 80 to maintain the sliding position of the movable plate 60. The detailed configuration of the angle holding portion 80 will be described later.

The movable plate 60 has movable-side through holes 61 into which the holding portions 43 of the support plate 40 are inserted. The movable-side through holes 61 are holes penetrating the movable plate 60. As viewed in a plan view from a direction perpendicular to the plate surface of the movable plate 60, each movable-side through hole 61 is formed into an arc shape projecting in a direction toward the portion where the fixed plate 50 is disposed. Therefore, the movable plate 60 can be arcuately moved, along the columnar portions 43*a* of the holding portions 43, in the left-and-right direction (X axis direction) against the support plate 40. Three movable-side through holes 61 are formed in the movable plate 60. The movable-side through hole 61 positioned at the center out of the three movable-side through holes 61 is formed at a position farther from the fixed plate 50 compared to other two through holes. The number of movable-side through holes 61 formed in the movable plate 60 is not limited to two, and may be one or three or more. As shown in FIG. 9, the movable-side through hole 61 has an interval L1 between an inner edge portion 61*a* and an outer edge portion 61*b*, and the interval L1 is greater than the thickness of the columnar portion 43*a* of the holding portion 43 shown in FIG. 7 in the front-and-rear direction (Y axis direction). The inner edge portion 61*a* forms apart of the movable-side through hole 61, and is disposed at a portion close to the portion where the fixed plate 50 is disposed. The outer edge portion 61*b* is disposed at a portion opposite to the portion where the fixed plate 50 is disposed. Further, the movable-side through hole 61 has the interval L1 between the inner edge portion 61*a* and the outer edge portion 61*b*, and the interval L1 is equal to or greater than an interval L2 between a far side wall portion 81*a* and a front side wall portion 81*b* of the angle holding portion 80 described later. The inner edge portion 61*a* forms apart of the movable-side through hole 61, and is disposed at the portion close to the portion where the fixed plate 50 is disposed. The outer edge portion 61*b* is disposed at the portion opposite to the portion where the fixed plate 50 is disposed. Therefore, the movable plate 60 can be moved in a direction approaching the fixed plate 50, or in a direction away from the fixed plate 50.

As shown in FIG. 8 to FIG. 10, the movable plate 60 includes a flat-plate-like graspable expanded portion 62 provided to protrude from a side surface portion at a portion opposite to the portion where the fixed plate 50 is disposed. The graspable expanded portion 62 is a portion provided for allowing a user to easily grasp the movable plate 60 when the user manually moves the movable plate 60. The distal end portion of the graspable expanded portion 62 in the protruding direction is provided with graspable protrusion portions 63 protruding from the plate surface of the graspable expanded portion 62. The graspable protrusion portions 63 are made of two plate parts facing each other. The two plate parts are formed such that end portions of the two plate parts in the protruding direction of the graspable expanded portion 62 approach each other, and end portions of the two plate parts close to the fixed plate 50 are separated from each other. Further, each graspable protrusion portion 63 is formed into an arc shape as viewed in a plan view from the direction perpendicular to the plate surface of the movable plate 60 such that the two plate parts facing each other project in a facing direction. The graspable protrusion portions 63 have such a configuration, thus allowing a user to easily hold the movable plate 60 when the user moves the movable plate 60.

(Wind Direction Plate 70)

Figure 11:
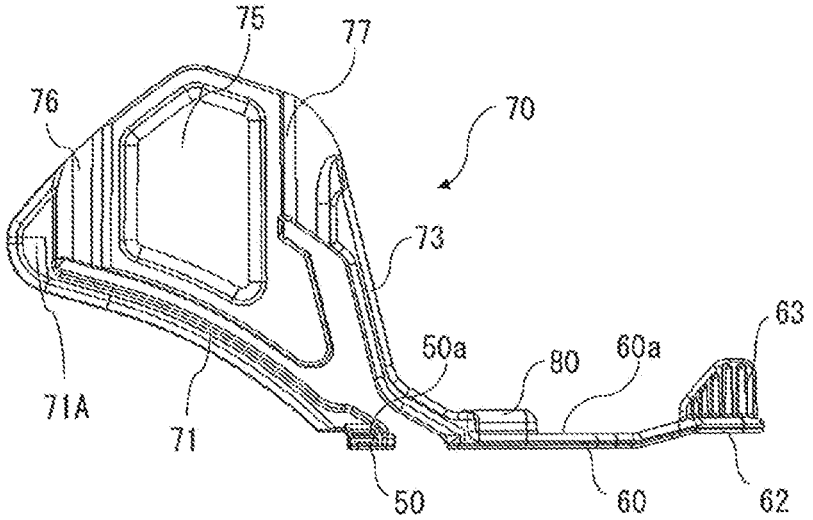
FIG. 11 is a cross-sectional view showing the wind direction plate shown in FIG. 9 and taken along line B-B.

FIG. 11 is a cross-sectional view showing the wind direction plate 70 shown in FIG. 9 and taken along line B-B. The structure of the wind direction plate 70 will be described with reference to FIG. 4, FIG. 8, FIG. 9, and FIG. 11. As shown in FIG. 8 and FIG. 11, each wind direction plate 70 is fixed to a surface portion 50*a* of the fixed plate 50. As shown in FIG. 9, the wind direction plate 70 includes a fixed-side columnar portion 71 protruding in a direction perpendicular to the long side direction of the fixed plate 50 as viewed in a plan view from a direction perpendicular to the plate surface of the fixed plate 50. The wind direction plate 70 is made of an elastic material, so that when a user moves the movable plate 60, the fixed-side columnar portions 71 are elastically deformed by pressure. When the wind direction adjustment mechanism 30 is disposed in the housing 1, as shown in FIG. 4, each fixed-side columnar portion 71 is disposed to protrude in a depth direction (Y axis direction) of the housing 1. The distal end of the fixed-side columnar portion 71 includes a fixed-side distal end portion 71A bending in a direction perpendicular to the surface portion 50*a* of the fixed plate 50. When the wind direction adjustment mechanism 30 is disposed in the housing 1, as shown in FIG. 4, the fixed-side distal end portion 71A is disposed at the farthest side (Y2 side) in the housing 1 among the components of the wind direction adjustment mechanism 30.

As shown in FIG. 8 and FIG. 11, the wind direction plate 70 also includes a movable-side columnar portion 73 fixed such that the movable-side columnar portion 73 is perpendicular to a surface portion 60*a* of the movable plate 60. The wind direction plate 70 is made of an elastic material, so that when a user moves the movable plate 60, the movable-side columnar portions 73 are elastically deformed by pressure. When the wind direction adjustment mechanism 30 is disposed in the housing 1, as shown in FIG. 4, the movable-side columnar portion 73 is disposed to extend in the vertical direction (Z axis direction) in the housing 1, and is disposed to protrude into the air supply path 8A. The proximal portion of the movable-side columnar portion 73 is provided with a wind direction plate mounting rib 64 that couples the plurality of movable-side columnar portions 73. The wind direction plate mounting rib 64 is provided to the movable plate 60 to extend in the long side direction (X axis direction) of the movable plate 60, and the wind direction plate mounting rib 64 is formed into a rectangular prism shape. With the use of the wind direction plate mounting rib 64, it is possible to ensure strength of the movable plate 60 at portions where an elastic force acts by the wind direction plates 70. Further, rigidity of the movable plate 60 can be ensured, so that the smooth movement of the movable plate 60 can be ensured.

As shown in FIG. 11, the wind direction plate 70 further includes a blade portion 75 between the fixed-side columnar portion 71 and the movable-side columnar portion 73. The blade portion 75 is a flat-plate-like plate. When the wind direction adjustment mechanism 30 is disposed in the housing 1, as shown in FIG. 4, the blade portion 75 forms a wall extending in the depth direction (Y axis direction) in the housing 1. The wind direction plate 70 further includes a fixed-side thin wall portion 76 and a movable-side thin wall portion 77 each of which is formed into a plate shape having a smaller thickness than the blade portion 75, and is elastically deformed by pressure. The fixed-side thin wall portion 76 is formed at a portion where the fixed-side columnar portion 71 and the blade portion 75 are coupled to each other, and the movable-side thin wall portion 77 is formed at a portion where the movable-side columnar portion 73 and the blade portion 75 are coupled to each other. The fixed-side columnar portion 71 and the blade portion 75 are integrally formed via the fixed-side thin wall portion 76. Further, the movable-side columnar portion 73 and the blade portion 75 are integrally formed via the movable-side thin wall portion 77. That is, the fixed-side columnar portion 71, the movable-side columnar portion 73, the blade portion 75, the fixed-side thin wall portion 76, and the movable-side thin wall portion 77 of the wind direction plate 70 are integrally formed. The wall thickness of the fixed-side thin wall portion 76 and the wall thickness of the movable-side thin wall portion 77 are set smaller than the wall thickness of the blade portion 75, the wall thickness of the fixed-side columnar portion 71 and the wall thickness of the movable-side columnar portion 73.

Figure 12:
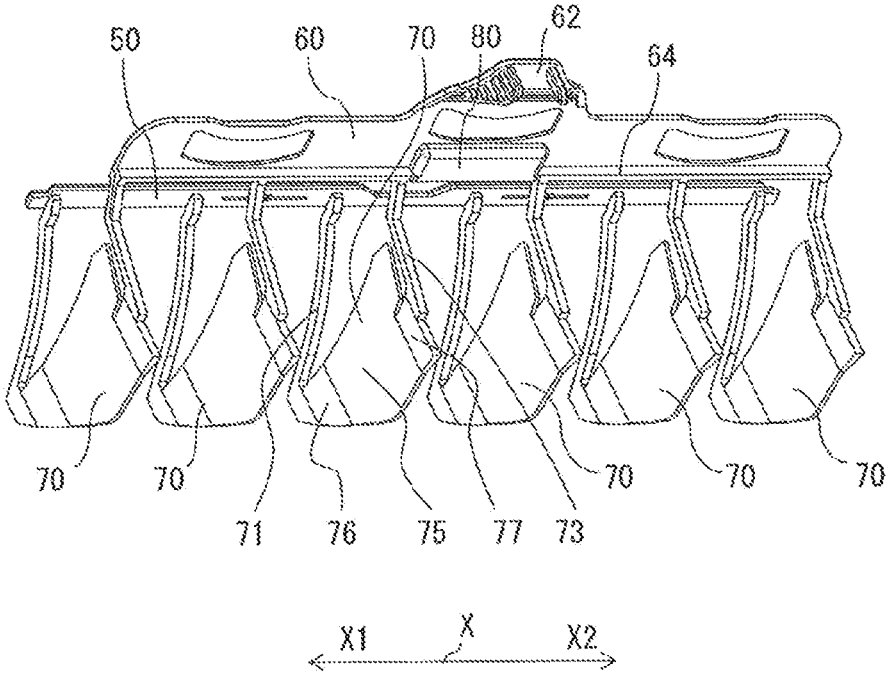
FIG. 12 is a perspective view showing a modification of the wind direction plates when the movable plate shown in FIG. 8 is moved.
Figure 13:
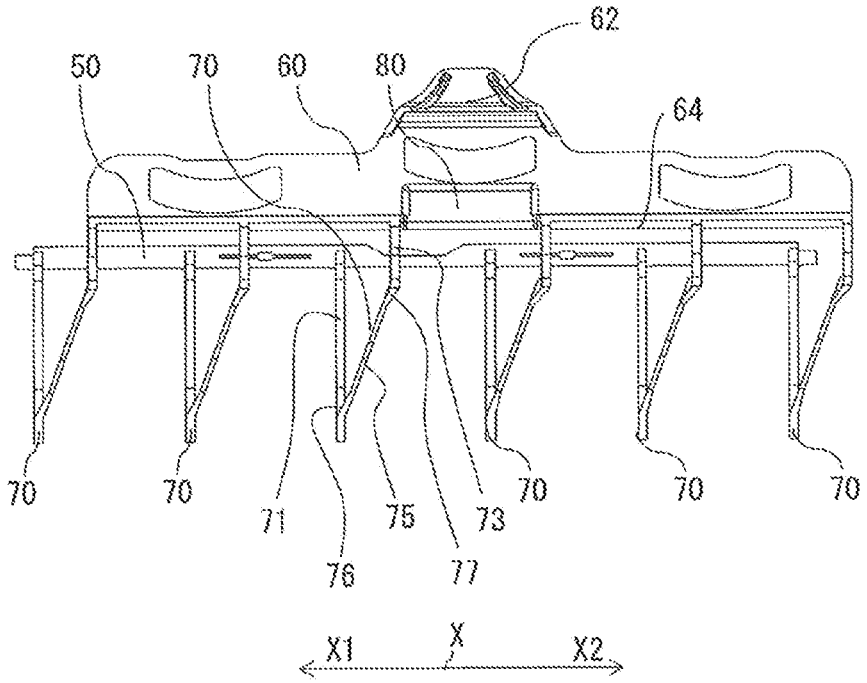
FIG. 13 is a plan view showing the modification of the wind direction plates when the movable plate shown in FIG. 9 is moved.

FIG. 12 is a perspective view showing a modification of the wind direction plates 70 when the movable plate 60 shown in FIG. 8 is moved. FIG. 13 is a plan view showing the modification of the wind direction plates 70 when the movable plate 60 shown in FIG. 9 is moved. The mode of the wind direction plates 70 when a user moves the movable plate 60 in the left-and-right direction (X axis direction) will be described with reference to FIG. 12 and FIG. 13. When the user moves the movable plate 60 in the arrangement direction of the wind direction plates 70 (X axis direction), each fixed-side thin wall portion 76 and each movable-side thin wall portion 77 are bent, and the fixed-side columnar portion 71 and the movable-side columnar portion 73 are brought into a twisted state and hence, an elastic restoring force is generated in each wind direction plate 70. Further, when the movable plate 60 is horizontally moved on the same plane as the fixed plate 50, each fixed-side thin wall portion 76 and each movable-side thin wall portion 77 are bent, so that the blade portions 75 are perpendicular to a horizontal plane, but are inclined relative to the long side direction (X axis direction) of the fixed plate 50.

(Angle Holding Portion 80)

Figure 14:
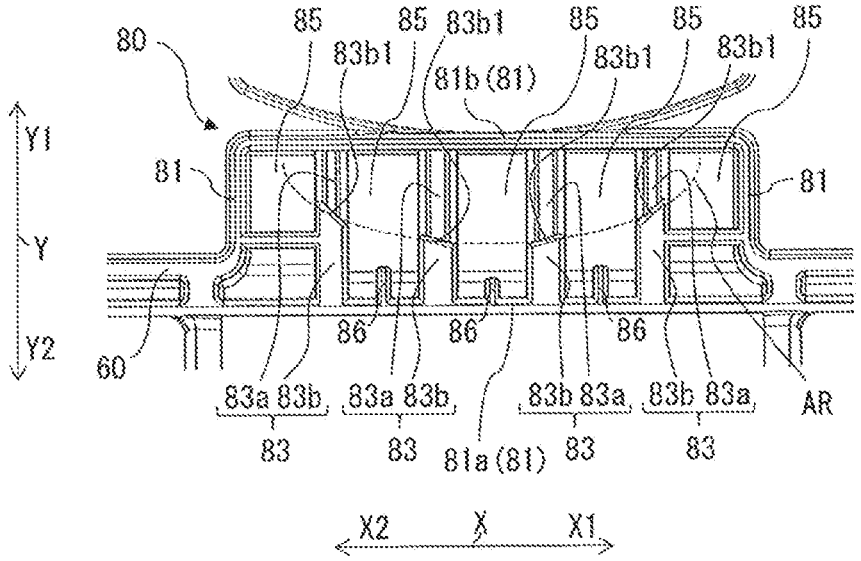
FIG. 14 is an enlarged plan view of a portion C showing an angle holding portion shown in FIG. 9.
Figure 15:
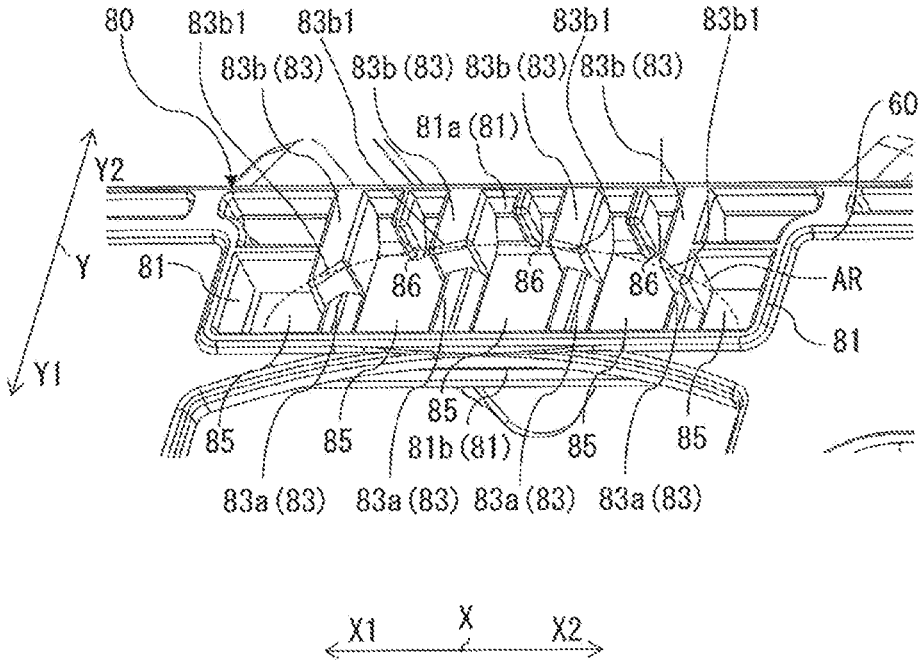
FIG. 15 is an enlarged perspective view of a portion D showing the angle holding portion shown in FIG. 10.

FIG. 14 is an enlarged plan view of a portion C showing the angle holding portion 80 shown in FIG. 9. FIG. 15 is an enlarged perspective view of a portion D showing the angle holding portion 80 shown in FIG. 10. The angle holding portion 80 will be described with reference to FIG. 4, FIG. 8, FIG. 14, and FIG. 15. The angle holding portion 80 maintains, in combination with the holding protrusion 41 formed on the support plate 40, the position of the movable plate 60 moved by a user along the surface portion 40*a* of the support plate 40. As shown in FIG. 8, FIG. 14, and FIG. 15, the angle holding portion 80 includes a side wall portion 81 forming a rectangular frame structure. The side wall portion 81 includes the far side wall portion 81*a* and the front side wall portion 81*b*. The far side wall portion 81*a* protrudes from a portion opposite to the portion where the support plate 40 is disposed, and the far side wall portion 81*a* faces the portion where the fixed plate 50 is disposed. The front side wall portion 81*b* is disposed on a side opposite to the far side wall portion 81*a*. As shown in FIG. 14 and FIG. 15, the angle holding portion 80 also includes the plurality of partition wall portions 83 each of which couples the far side wall portion 81*a* and the front side wall portion 81*b* to each other, the partition wall portions 83 being formed in parallel. As shown in FIG. 14, the partition wall portions 83 partition a range surrounded by the side wall portion 81 such that a plurality of spaces arranged in the long side direction of the movable plate 60 are formed as viewed in a plan view from the direction perpendicular to the plate surface of the movable plate 60. The angle holding portion 80 holds the holding protrusion 41 formed on the support plate 40 in the space formed between the side wall portion 81 and the partition wall portions 83, thus restricting the movement of the movable plate 60.

As shown in FIG. 8, FIG. 14, and FIG. 15, the angle holding portion 80 includes flat-plate-like top plate portions 85 at a distal end portion of the side wall portion 81 in the protruding direction, the top plate portions 85 being provided between the partition wall portions 83 and the side wall portion 81. The top plate portions 85 are provided to cover opening ports disposed at the distal end of the side wall portion 81 formed into a sleeve shape. As shown in FIG. 4, the angle holding portion 80 is disposed to face the air supply path 8A. Therefore, air blown from the fan 11 passes through the angle holding portion 80. The angle holding portion 80 includes the top plate portions 85 formed into a flat plate shape, thus preventing the disturbance of the flow of wind passing through the angle holding portion 80. Further, as shown in FIG. 8, each of the plurality of partition wall portions 83 has a groove portion 85*a* on a side opposite to the side where the support plate 40 is disposed. The groove portion 85*a* is formed on the wall portion of the partition wall portion 83, the wall portion being positioned at the portion opposite to the portion where the support plate 40 is disposed, and the groove portion 85*a* is formed along the extending direction of the partition wall portion 83. Further, the plurality of partition wall portions 83 are formed in parallel to each other, so that the groove portions 85*a* are also formed in parallel to each other. The partition wall portions 83 have the groove portions 85*a*, so that the angle holding portion 80 can straighten the flow of air blown from the fan 11 and flowing along the angle holding portion 80 without causing disturbance.

As shown in FIG. 14 and FIG. 15, the angle adjustment portion 83*a* and the angle restricting portion 83*b* of each partition wall portion 83 are integrally formed. The angle adjustment portion 83*a* is a portion protruding from the front side wall portion 81*b* toward the far side wall portion 81*a* at the distal end portion of the side wall portion 81 in the protruding direction. The angle restricting portion 83*b* is a portion protruding from the far side wall portion 81*a* toward the front side wall portion 81*b*, coupling to the angle adjustment portion 83*a*, and formed to have a larger wall thickness than the angle adjustment portion 83*a* in the direction perpendicular to the plate surface of the movable plate 60. The term "wall thickness" of this "large wall thickness" means the thickness of the wall of the partition wall portion 83 in the direction perpendicular to the plate surface of the movable plate 60, that is, the thickness of the wall of the angle adjustment portion 83*a* or the angle restricting portion 83*b* in the direction perpendicular to the plate surface of the movable plate 60. In other words, the term "wall thickness" of this "large wall thickness" means the height of the wall of the partition wall portion 83, and is the height of the wall of the angle adjustment portion 83*a* or the angle restricting portion 83*b*. This "large wall thickness" means that a wall has a large thickness, and means a state where the wall has a large thickness in the direction perpendicular to the plate surface of the movable plate 60 and, in other words, means a state where the wall has a large height. Therefore, the description where the angle restricting portion 83*b* is formed to have a larger wall thickness than the angle adjustment portion 83*a* means a state where, in the direction perpendicular to the plate surface of the movable plate 60, the wall of the angle restricting portion 83*b* is formed to have a thickness larger than the thickness of the wall of the angle adjustment portion 83*a*. In other words, the description where the angle restricting portion 83*b* is formed to have a larger wall thickness than the angle adjustment portion 83*a* means a state where the wall of the angle restricting portion 83*b* is formed to have the height larger than the height of the wall of the angle adjustment portion 83*a*. The thickness of the wall in this embodiment means, in the direction perpendicular to the plate surface of the movable plate 60, the thickness of the wall in the direction toward the plate surface of the movable plate 60 from the distal end portion of the side wall portion 81 in the protruding direction. The height of the wall means, in the direction perpendicular to the plate surface of the movable plate 60, the height of the wall in the direction toward the plate surface of the movable plate 60 from the distal end portion of the side wall portion 81 in the protruding direction, and the height of the wall protruding into the space surrounded by the side wall portion 81. As shown in FIG. 15, in the direction perpendicular to the plate surface of the movable plate 60, the angle restricting portion 83*b* has a larger thickness than the angle adjustment portion 83*a*. In other words, within a range of the angle adjustment portion 83*a*, the surface of the partition wall portion 83 is recessed on the side facing the support plate 40. Alternatively, the angle adjustment portion 83*a* of the partition wall portion 83 is a portion where a cut-out portion is formed on the surface of the partition wall portion 83 on the side facing the support plate 40. The partition wall portion 83 has steps each of which is positioned at a portion where the angle restricting portion 83*b* and the angle adjustment portion 83*a* are coupled to each other.

The angle adjustment portions 83*a* come into contact with the side surface portions 41*a* of the holding protrusion 41 of the support plate 40 during the movement of the movable plate 60 in the front-and-rear direction (Y axis direction) performed by a user, thus serving as guides restricting the moving direction of the movable plate 60. Further, each angle adjustment portion 83*a* is a portion that is formed to have a smaller wall thickness than the angle restricting portion 83*b*, and that passes over the holding protrusion 41 of the support plate 40 when the user moves the movable plate 60 in the left-and-right direction (X axis direction). The angle adjustment portion 83*a* is formed into a trapezoidal shape in transverse cross section projecting in a direction toward the portion where the support plate 40 is disposed. The angle adjustment portion 83*a* is formed into a trapezoidal shape in transverse cross section projecting in the direction toward the portion where the support plate 40 is disposed and hence, the angle adjustment portion 83*a* serves as a guide for the movable plate 60. Further, when a user moves the movable plate 60 in the left-and-right direction (X axis direction), the movable plate 60 can easily pass over the holding protrusion 41, so that easy manipulation can be realized. The corner portions of the angle adjustment portion 83*a* may be chamfered. By chamfering the corner portions of the angle adjustment portion 83*a*, the movable plate 60 can easily pass over the holding protrusion 41 when the user moves the movable plate 60 in the left-and-right direction (X axis direction), so that the movable plate 60 can be manipulated more easily.

The angle restricting portions 83*b* come into contact with the side surface portions 41*a* of the holding protrusion 41 of the support plate 40, thus serving as a part restricting the movement of the movable plate 60 in the left-and-right direction (X axis direction). When a user moves the movable plate 60 in the left-and-right direction (X axis direction), a pressure of returning to the original position is applied to the movable plate 60 due to the elastic restoring force of the wind direction plates 70. However, the angle restricting portions 83*b* come into contact with the side surface portions 41*a* of the holding protrusion 41, thus restricting the movement of the movable plate 60 in the left-and-right direction (X axis direction). The angle restricting portions 83*b* also come into contact with the side surface portions 41*a* of the holding protrusion 41 of the support plate 40 during the movement of the movable plate 60 in the front-and-rear direction (Y axis direction) performed by the user, thus serving as guides defining the moving direction of the movable plate 60. The angle restricting portion 83*b* is formed into a quadrangular prism shape extending from the far side wall portion 81*a* toward the front side wall portion 81*b*. The side surfaces of two neighboring angle restricting portions 83*b* face each other. As shown in FIG. 14 and FIG. 15, the angle restricting portions 83*b* are formed such that as a distance from the center toward either of both end portions of the far side wall portion 81*a* increases in the arrangement direction of the plurality of partition wall portions 83, the length the angle restricting portion 83*b* in the protruding direction increases. When the user moves the movable plate 60 in the left-and-right direction (X axis direction), the movable-side columnar portion 73 of each wind direction plate 70 moves arcuately about the fixed-side columnar portion 71. Therefore, the movable plate 60 fixed to the movable-side columnar portions 73 moves arcuately along the locus of the movement of the movable-side columnar portion 73. The angle restricting portions 83*b* are formed such that as a distance from the center toward either of both end portions of the far side wall portion 81*a* increases, the protruding length of the angle restricting portion 83*b* increases. Therefore, in the wind direction adjustment mechanism 30, the holding protrusion 41 of the support plate 40 and the angle restricting portion 83*b* can be caused to come into contact with each other along the moving direction of the movable plate 60 moving arcuately.

As shown in FIG. 14 and FIG. 15, each angle restricting portion 83*b* has a distal end portion 83*b*1 positioned at a boundary between the angle adjustment portion 83*a* and the angle restricting portion 83*b*. When the center portion in the width direction of the distal end portion 83*b*1 of one angle restricting portion 83*b* and the center portions of the distal end portions 83*b*1 of the neighboring angle restricting portions 83*b* are connected by an imaginary line, the imaginary line forms an arc shape AR as viewed in a plan view from the direction perpendicular to the plate surface of the movable plate 60. As described above, the movable plate 60 fixed to the movable-side columnar portions 73 moves arcuately. When the center portion in the width direction of the distal end portion 83*b*1 of one angle restricting portion 83*b* and the center portions of the distal end portions 83*b*1 of the neighboring angle restricting portions 83*b* are connected by an imaginary line, the imaginary line is formed into the arc shape AR. Therefore, in the wind direction adjustment mechanism 30, the holding protrusion 41 of the support plate 40 and the angle restricting portion 83*b* can be caused to come into contact with each other along the moving direction of the movable plate 60 moving arcuately.

Further, the distal end portion 83*b*1 of each angle restricting portion 83*b* has an inclined surface inclined toward the center portion of the movable plate 60 in the long side direction (X axis direction) as viewed in a plan view from the direction perpendicular to the plate surface of the movable plate 60. As described above, the movable plate 60 fixed to the movable-side columnar portions 73 moves arcuately. Therefore, when a user moves the movable plate 60 in a direction from the center toward either of both end portions of the far side wall portion 81*a*, the distal end portion 83*b*1 of the angle restricting portion 83*b* is easily moved along the holding protrusion 41, so that the user can easily manipulate the movable plate 60. Whereas after the movable plate 60 is moved, the angle restricting portion 83*b* is prevented from being easily removed from the holding protrusion 41 since the distal end portion 83*b*1 has the inclined surface inclined toward the center portion of the movable plate 60 in the long side direction, so that the side wall of the angle restricting portion 83*b* disposed at a portion close to the end portion has a larger length than the side wall of the angle restricting portion 83*b* disposed at a portion close to the center. Therefore, the wind direction adjustment mechanism 30 can hold the angle of the wind direction plates 70 with certainty.

As shown in FIG. 14 and FIG. 15, the angle holding portion 80 includes ribs 86 each of which is formed in a space between two neighboring partition wall portions 83, and which protrudes from the far side wall portion 81*a* toward the front side wall portion 81*b*. The ribs 86 are formed such that as a distance from the center toward either of both end portions of the far side wall portion 81*a* increases in the arrangement direction of the plurality of partition wall portions 83, the length of the rib 86 in the protruding direction increases. In a state where the fixed plate 50 and the movable plate 60 are disposed on the support plate 40, the holding protrusion 41 of the support plate 40 is disposed between two neighboring partition wall portions 83. The angle holding portion 80 includes the ribs 86, thus restricting the movement of the movable plate 60 in the front-and-rear direction (Y axis direction) against the holding protrusion 41. Further, the angle holding portion 80 includes the ribs 86, thus ensuring strength of the angle holding portion 80 that comes into contact with the holding protrusion 41. When a user moves the movable plate 60 in the left-and-right direction (X axis direction), the movable-side columnar portion 73 of each wind direction plate 70 moves arcuately about the fixed-side columnar portion 71. Therefore, the movable plate 60 fixed to the movable-side columnar portions 73 moves arcuately. The ribs 86 are formed such that as a distance from the center toward either of both end portions of the far side wall portion 81*a* increases, the protruding length of the rib 86 increases. Therefore, it is possible to cause the holding protrusion 41 of the support plate 40 to come into contact with the rib 86 along the moving direction of the movable plate 60 moving arcuately.

Figure 16:
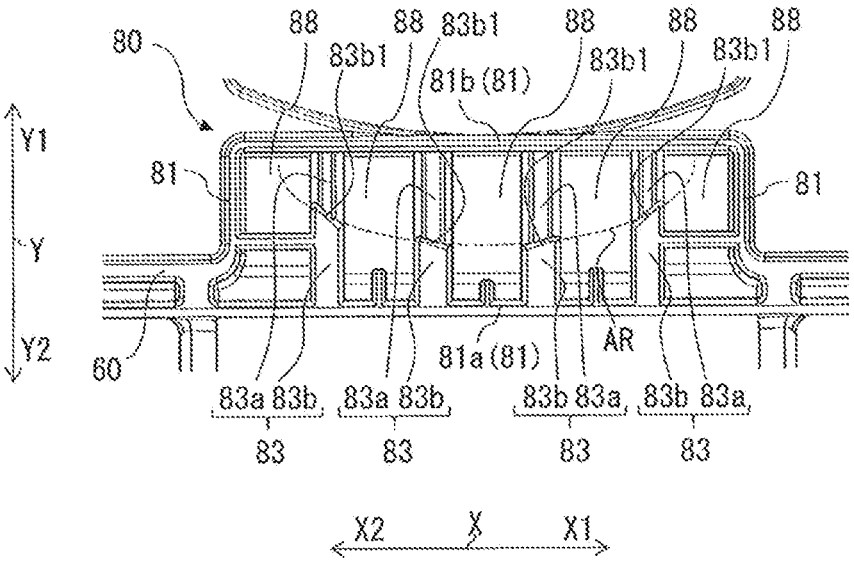
FIG. 16 is an enlarged plan view of the portion C showing a modification of the angle holding portion shown in FIG. 9.

FIG. 16 is an enlarged plan view of a portion C showing the modification of the angle holding portion 80 shown in FIG. 9. Note that, in the angle holding portion 80 of the modification, portions having substantially the same configuration as the corresponding portions of the wind direction adjustment mechanism 30 shown in FIG. 1 to FIG. 15 are given the same symbols, and the description of such portions is omitted. The angle holding portion 80 shown in FIG. 8, FIG. 14, and FIG. 15 includes the flat-plate-like top plate portions 85 at the distal end portion of the side wall portion 81 in the protruding direction, the top plate portions 85 being provided between the partition wall portions 83 and the side wall portion 81. In contrast, the angle holding portion 80 of the modification does not include the top plate portion 85. The angle holding portion 80 includes the side wall portion 81 formed into a sleeve shape. The angle holding portion 80 has open ends in the vertical direction, and the partition wall portions 83 are provided between the far side wall portion 81*a* and the front side wall portion 81*b*. That is, the angle holding portion 80 of the modification has opening ports 88 each of which is formed between the partition wall portion 83 and the side wall portion 81. The angle holding portion 80 of the modification also has the opening ports 88 formed between the plurality of neighboring partition wall portions 83. The opening ports 88 are through holes. The angle holding portion 80 has the opening ports 88 that are through holes formed between the partition wall portions 83 and the side wall portion 81, so that a user can check visually or by touch the position of the holding protrusion 41 of the support plate 40 in the angle holding portion 80.

[Manner of Operation of Wind Direction Adjustment Mechanism 30]

Figure 17:
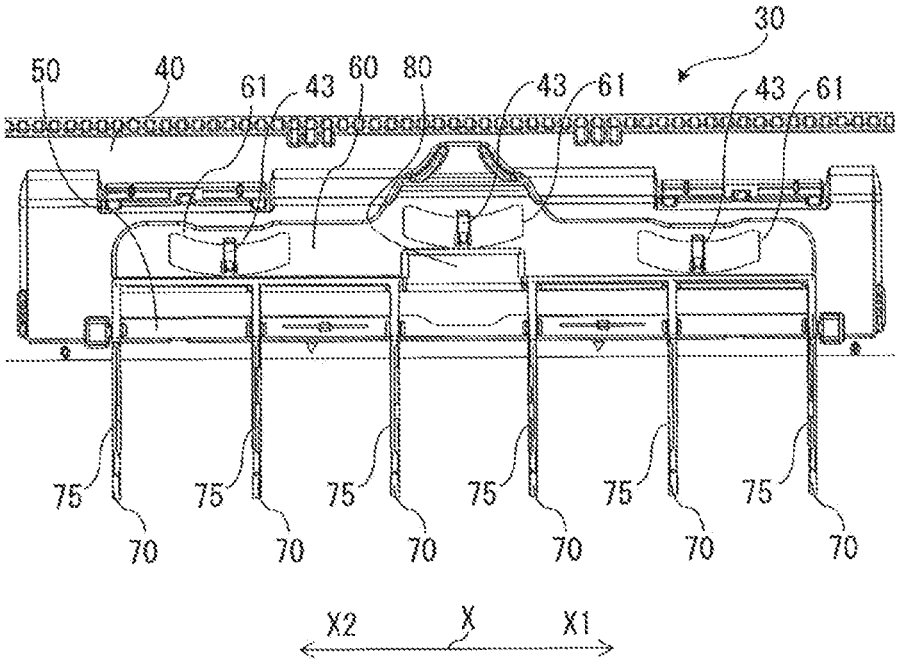
FIG. 17 is a bottom view of the wind direction adjustment mechanism in a state where blade portions shown in FIG. 8 are perpendicular to the long side direction of the fixed plate.
Figure 18:
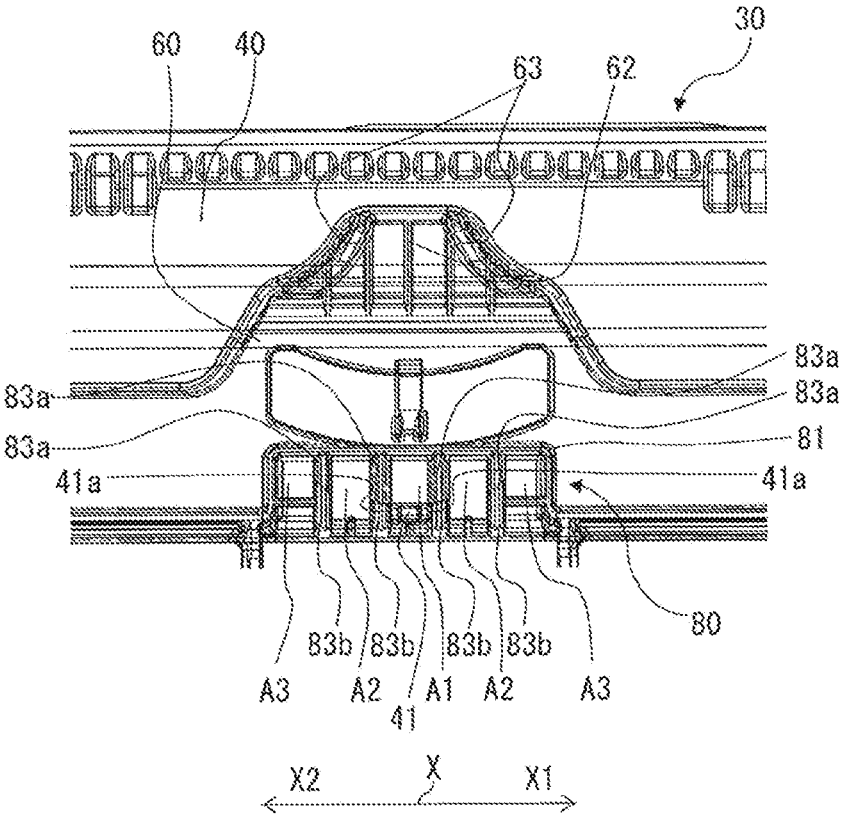
FIG. 18 is a conceptual diagram showing a positional relationship between the angle holding portion and a holding protrusion when the blade portions are in the angle position shown in FIG. 17.

FIG. 17 is a bottom view of the wind direction adjustment mechanism 30 in a state where the blade portions 75 shown in FIG. 8 are perpendicular to the long side direction of the fixed plate 50. FIG. 18 is a conceptual diagram showing the positional relationship between the angle holding portion 80 and the holding protrusion 41 when the blade portions 75 are in the angle position shown in FIG. 17. Note that the movable plate 60 shown in FIG. 18 is shown in a see-through manner to clearly describe the positional relationship between the angle holding portion 80 and the holding protrusion 41. In the case where conditioned air is blown out in the front direction from the indoor unit 100 shown in FIG. 1, as shown in FIG. 17, a user adjusts the angle of the wind direction plates 70 such that the blade portions 75 are perpendicular to the long side direction (X axis direction) of the fixed plate 50. At this point of operation, the user inserts, as shown in FIG. 14 and FIG. 18, the holding protrusion 41 into a center space A1 surrounded by the partition wall portions 83 and the side wall portion 81 of the angle holding portion 80. A plurality of spaces surrounded by the partition wall portions 83 and the side wall portion 81 are formed in the angle holding portion 80 along the long side direction of the movable plate 60. In the long side direction of the movable plate 60, a space positioned at the center portion of the angle holding portion 80 is referred to as "center space A1", and spaces formed in the direction toward each end portion of the angle holding portion 80 from the center space A1 are respectively referred to as "first side space A2" and "second side space A3". In a state where the fixed plate 50 and the movable plate 60 are disposed on the support plate 40, in the angle holding portion 80, the movable plate 60 is biased by the elastic restoring force of the wind direction plates 70 in a direction opposite to the direction toward the portion where the fixed plate 50 is disposed. When the movable plate 60 is biased as described above, the holding protrusion 41 formed on the support plate 40 is disposed in the space surrounded by the partition wall portions 83 and the side wall portion 81, thus restricting the movement of the movable plate 60 in the direction opposite to the direction toward the portion where the fixed plate 50 is disposed. When the holding protrusion 41 is disposed in the center space A1 of the movable plate 60, the angle restricting portions 83*b* come into contact with the side surface portions 41*a* of the holding protrusion 41, so that the movement of the movable plate 60 in the left-and-right direction (X axis direction) is restricted. Therefore, the angle of the blade portions 75 of the wind direction plates 70 coupled to the fixed plate 50 and the movable plate 60 is fixed in a state where the blade portions 75 are perpendicular to the long side direction of the fixed plate 50. Accordingly, the indoor unit 100 can blow out conditioned air in the front direction. As shown in FIG. 17 and FIG. 18, when the blade portions 75 are perpendicular to the long side direction of the fixed plate 50, the holding protrusion 41 is positioned at the center of the angle holding portion 80, and the fixed-side thin wall portions 76 and the movable-side thin wall portions 77 are not bent and deformed.

Figure 19:
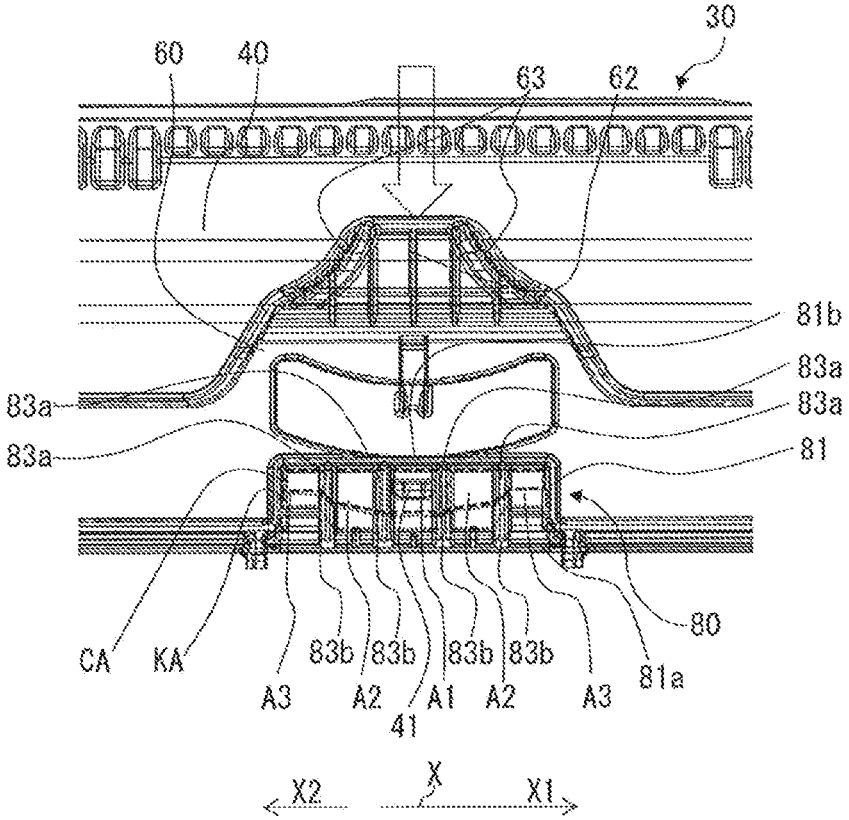
FIG. 19 is a conceptual diagram showing the positional relationship between the angle holding portion and the holding protrusion when a user pushes the movable plate shown in FIG. 18.
Figure 20:
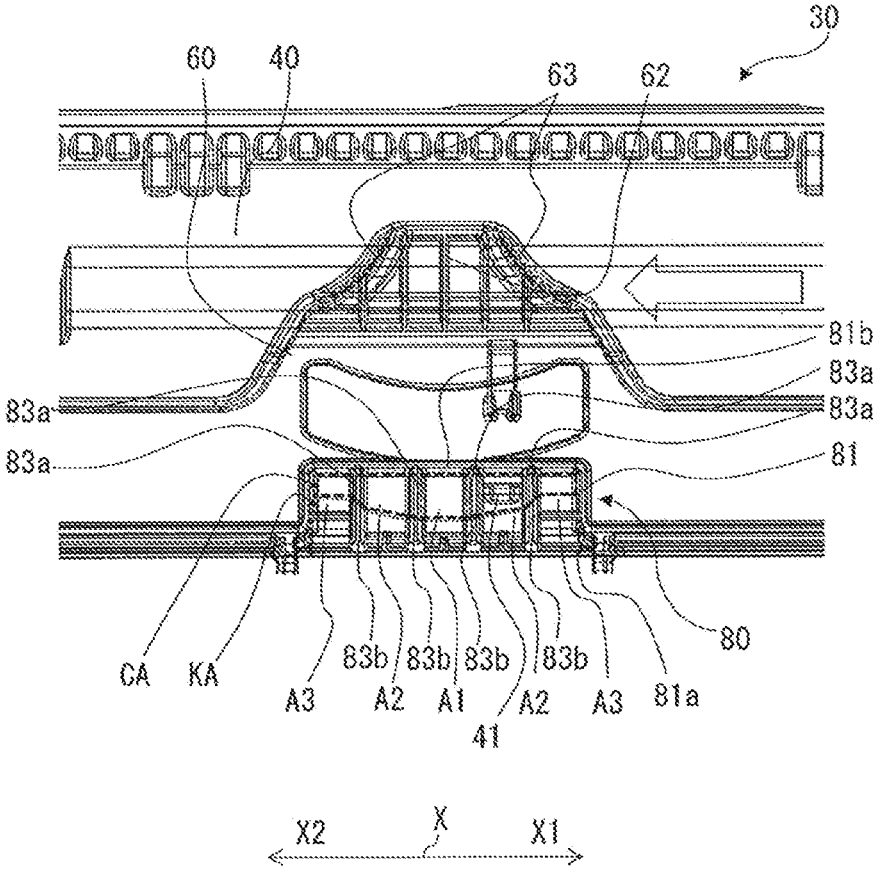
FIG. 20 is a conceptual diagram showing the positional relationship between the angle holding portion and the holding protrusion when the user moves the movable plate shown in FIG. 18 in a left-and-right direction.
Figure 21:
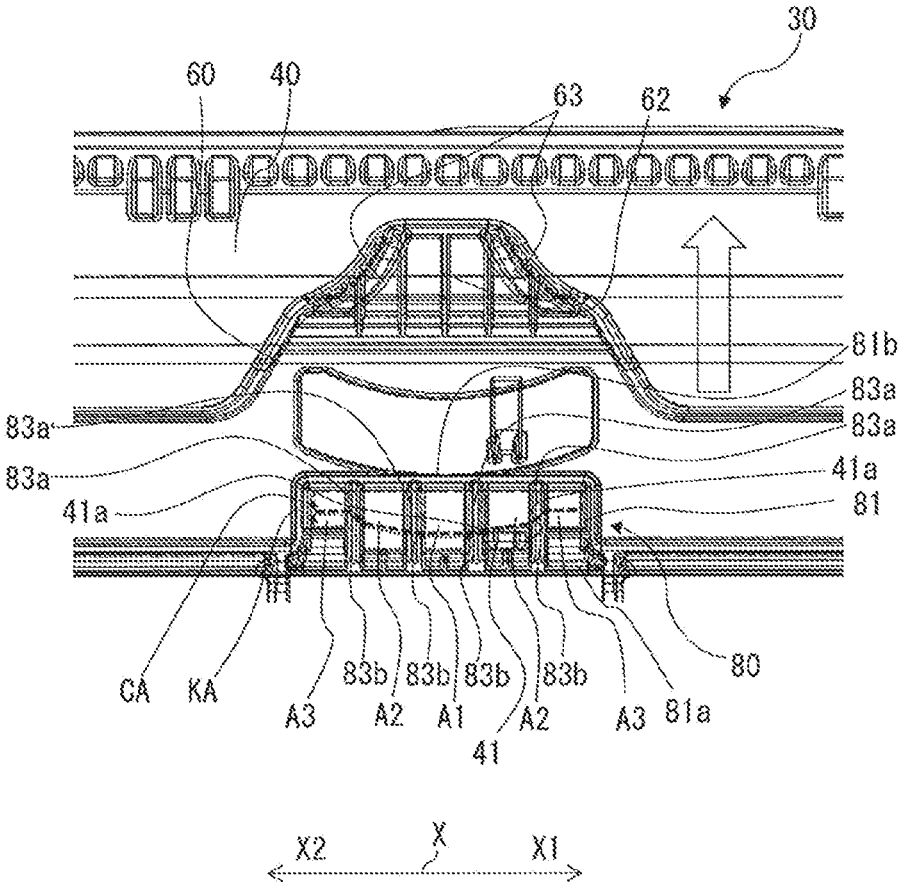
FIG. 21 is a conceptual diagram showing the positional relationship between the angle holding portion and the holding protrusion when the user finishes the movement of the movable plate shown in FIG. 18 in the left-and-right direction.

FIG. 19 is a conceptual diagram showing the positional relationship between the angle holding portion 80 and the holding protrusion 41 when a user pushes the movable plate 60 shown in FIG. 18. FIG. 20 is a conceptual diagram showing the positional relationship between the angle holding portion 80 and the holding protrusion 41 when the user moves the movable plate 60 shown in FIG. 18 in the left-and-right direction. FIG. 21 is a conceptual diagram showing the positional relationship between the angle holding portion 80 and the holding protrusion 41 when the user finishes the movement of the movable plate 60 shown in FIG. 18 in the left-and-right direction. In the same manner as FIG. 18, the movable plate 60 shown in FIG. 19 to FIG. 21 is shown in a see-through manner to clearly describe the positional relationship between the angle holding portion 80 and the holding protrusion 41. Next, the manner of operation of the wind direction adjustment mechanism 30 when conditioned air is blown out in the left-and-right direction (X axis direction) of the indoor unit 100 shown in FIG. 1 will be described with reference to FIG. 19 to FIG. 21. Note that, in the short side direction between the far side wall portion 81*a* and the front side wall portion 81*b* of the angle holding portion 80, a range where the angle adjustment portions 83*a* are provided is referred to as "angle adjusting range CA", and a range where the angle restricting portions 83*b* are provided is referred to as "angle holding range KA". In FIG. 19 to FIG. 21, the angle adjusting range CA is shown by a broken line, and the angle holding range KA is shown by a dotted line. The angle adjustment portions 83*a* are portions formed to have a small wall thickness in a direction perpendicular to the movable plate 60. In the case where the holding protrusion 41 is in the angle adjusting range CA, the angle adjustment portion 83*a* can pass over the holding protrusion 41 when a user moves the movable plate 60. Therefore, when the holding protrusion 41 is in the angle adjusting range CA, the movable plate 60 can be moved in the left-and-right direction (X axis direction). In contrast, when the holding protrusion 41 is in the angle holding range KA, the user cannot move the movable plate 60 in the left-and-right direction (X axis direction). The angle restricting portions 83*b* are portions formed to have a large wall thickness in the direction perpendicular to the movable plate 60. In the case where the holding protrusion 41 is in the angle holding range KA, even if a user attempts to move the movable plate 60, the side walls of the angle restricting portions 83*b* come into contact with the side surface portions 41*a* of the holding protrusion 41. Therefore, the angle restricting portion 83*b* is not allowed to pass over the holding protrusion 41, so that the movement of the movable plate 60 is restricted.

First, a user grasps the graspable protrusion portions 63 of the movable plate 60, and pushes and moves movable plate 60 in a direction shown by an arrow in FIG. 19, that is, in the direction toward the portion where the fixed plate 50 is disposed. When the user moves the movable plate 60 in the direction toward the portion where the fixed plate 50 is disposed, the holding protrusion 41 moves from the angle holding range KA to the angle adjusting range CA of the angle holding portion 80. At this point of operation, the angle adjustment portions 83*a* and the angle restricting portions 83*b* come into contact with the side surface portions 41*a* of the holding protrusion 41 of the support plate 40 during the movement of the movable plate 60 in the front-and-rear direction (Y axis direction) performed by the user, thus serving as guides defining the moving direction of the movable plate 60. At this point of operation, each wind direction plate 70 is deformed such that the movable-side columnar portion 73 and the fixed-side columnar portion 71 approach each other. Therefore, the wind direction plates 70 apply pressure to the movable plate 60 by an elastic restoring force to move the movable plate 60 in the direction opposite to the direction toward the portion where the fixed plate 50 is disposed.

Next, the user moves the movable plate 60 in the arrangement direction of the wind direction plates 70 (X axis direction) as shown in FIG. 20. An arrow shown in FIG. 20 shows the moving direction of the movable plate 60. The movable plate 60 moves against the fixed plate 50 on the same plane while describing the locus having an arc shape having a radius of curvature that is the distance between the fixed-side thin wall portion 76 and the movable-side thin wall portion 77 (corresponding to a value slightly larger than the width of the blade portion 75). At this point of operation, since the angle adjustment portion 83*a* is a portion formed to have a smaller wall thickness than the angle restricting portion 83*b*, the angle adjustment portion 83*a* can pass over the holding protrusion 41 of the support plate 40 when the user moves the movable plate 60 in the arrangement direction of the wind direction plates 70 (X axis direction). That is, in the angle adjusting range CA, the angle adjustment portion 83*a* can pass over the holding protrusion 41, so that the user can move the movable plate 60 in the left-and-right direction (X axis direction). When the user moves the movable plate 60, the holding protrusion 41 is disposed to the first side space A2.

Lastly, when the user reduces a force of pushing the movable plate 60 in the direction toward the fixed plate 50, by the above-mentioned elastic restoring force of the wind direction plates 70, the movable plate 60 moves in the direction opposite to the direction toward the portion where the fixed plate 50 is disposed as shown in FIG. 21. An arrow shown in FIG. 21 shows the moving direction of the movable plate 60. At this point of operation, the angle adjustment portions 83*a* and the angle restricting portions 83*b* come into contact with the side surface portions 41*a* of the holding protrusion 41 during the movement of the movable plate 60 in the front-and-rear direction (Y axis direction), thus serving as guides defining the moving direction of the movable plate 60. The movable plate 60 moves in the direction opposite to the direction toward the portion where the fixed plate 50 is disposed, so that the holding protrusion 41 is disposed in the angle holding range KA. In the angle holding range KA, the side walls of the angle restricting portions 83*b* come into contact with the side surface portions 41*a* of the holding protrusion 41, so that the movable plate 60 cannot move in the left-and-right direction (X axis direction), that is, in the long side direction of the movable plate 60. When the holding protrusion 41 is disposed at a position away from the center of the angle holding portion 80, each fixed-side thin wall portion 76 and each movable-side thin wall portion 77 are bent and deformed (being bent in an L shape in a horizontal plane). Therefore, such deformation generates an "elastic restoring force" that acts in a direction where the amount of bending and deformation of the fixed-side thin wall portion 76 and the movable-side thin wall portion 77 is reduced, that is, in a direction where the holding protrusion 41 is caused to approach the center of the angle holding portion 80 (that is, an elastic restoring force that attempts to return the blade portions 75 to a state where the blade portions 75 are perpendicular to the long side direction of the fixed plate 50). At this point of operation, the holding protrusion 41 formed on the support plate 40 is disposed in a space surrounded by the partition wall portions 83 and the side wall portion 81, thus restricting the movement of the movable plate 60 in the direction opposite to the direction toward the portion where the fixed plate 50 is disposed. Further, the angle restricting portions 83*b* of the angle holding portion 80 come into contact with the side surface portions 41*a* of the holding protrusion 41, thus restricting the movement of the movable plate 60 caused by the elastic restoring force of the wind direction plates 70.

Figure 22:
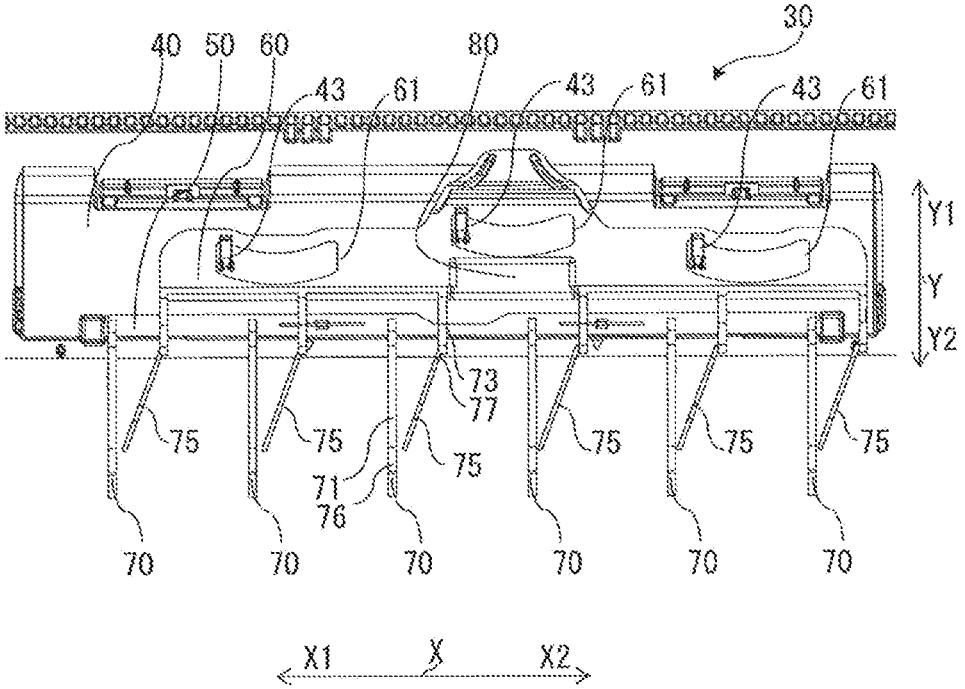
FIG. 22 is a bottom view showing the mode of the wind direction plates when the wind direction plates are moved in a direction opposite to the direction along which the movable plate in FIG. 21 is moved.
Figure 23:
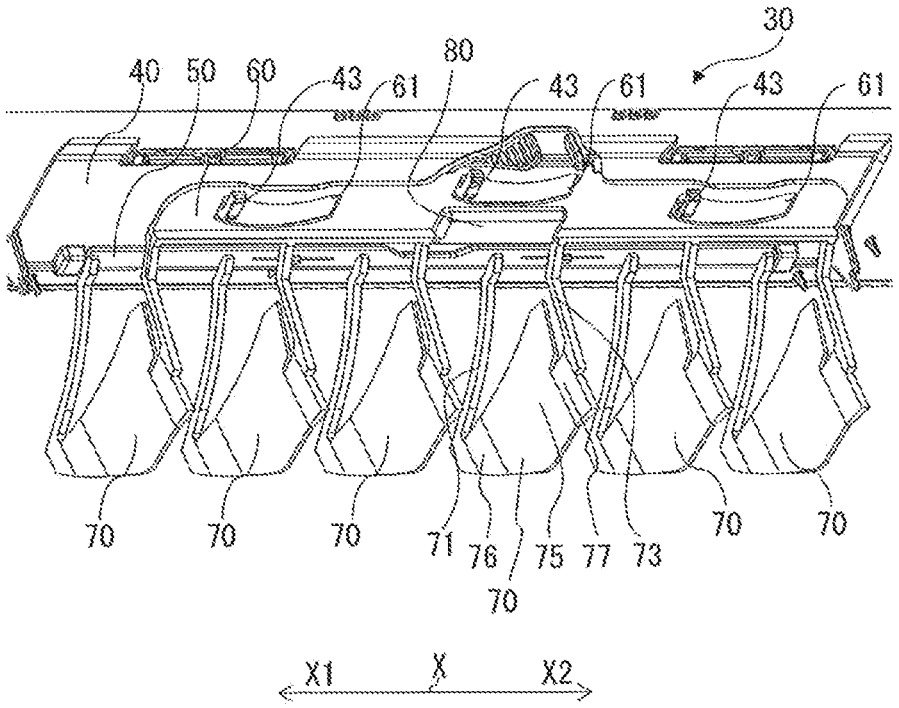
FIG. 23 is a perspective view showing the mode of the wind direction plates when the wind direction plates are moved in a direction opposite to the direction along which the movable plate in FIG. 21 is moved.

FIG. 22 is a bottom view showing the mode of the wind direction plates 70 when the wind direction plates 70 are moved in a direction opposite to the direction along which the movable plate 60 in FIG. 21 is moved. FIG. 23 is a perspective view showing the mode of the wind direction plates 70 when the wind direction plates 70 are moved in a direction opposite to the direction along which the movable plate 60 in FIG. 21 is moved. When the user moves the movable plate 60 in the arrangement direction of the wind direction plates 70 (X axis direction), each fixed-side thin wall portion 76 and each movable-side thin wall portion 77 are bent, so that the blade portions 75 are perpendicular to the horizontal plane, but are inclined relative to the long side direction (X axis direction) of the fixed plate 50. Accordingly, when the user manipulates the movable plate 60 in the left-and-right direction, the angle of the blade portions 75 of the wind direction plates 70 is changed and hence, it is possible to change the direction of conditioned air blown out from the indoor unit 100 in the left-and-right direction (X axis direction).

[Advantageous Effect of Wind Direction Adjustment Mechanism 30]

As described above, in the wind direction adjustment mechanism 30, in a state where the fixed plate 50 and the movable plate 60 are disposed on the support plate 40, the movable plate 60 is biased by the elastic restoring force of the wind direction plates 70 in the direction opposite to the direction toward the portion where the fixed plate 50 is disposed. The holding protrusion 41 is disposed in the space surrounded by the partition wall portions 83 and the side wall portion 81, thus restricting the movement of the movable plate 60 in the direction opposite to the direction toward the portion where the fixed plate 50 is disposed. Further, the angle restricting portions 83*b* come into contact with the holding protrusion 41, thus restricting the movement of the movable plate 60 in the left-and-right direction (X axis direction). Therefore, the wind direction adjustment mechanism 30 can hold the angle of the wind direction plates 70 without fail. Further, the angle adjustment portion 83*a* and the angle restricting portion 83*b* of each partition wall portion 83 are integrally formed at the distal end portion of the side wall portion 81 in the protruding direction. The angle adjustment portion 83*a* protrudes from the front side wall portion 81*b* toward the far side wall portion 81*a*, and the angle restricting portion 83*b* protrudes from the far side wall portion 81*a* toward the front side wall portion 81*b*, and couples to the angle adjustment portion 83*a*. This angle restricting portion 83*b* is formed to have a larger wall thickness than the angle adjustment portion 83*a* in the direction perpendicular to the plate surface of the movable plate 60. The angle adjustment portion 83*a* is formed to have a smaller wall thickness than the angle restricting portion 83*b* in the direction perpendicular to the movable plate 60. Accordingly, when the user moves the movable plate 60, the angle adjustment portion 83*a* can pass over the holding protrusion 41, so that manipulation can be easily performed in changing the angle of the wind direction plates 70. Further, the partition wall portions 83 of the movable plate 60 are guided by the holding protrusion 41, so that the user can smoothly move the holding protrusion 41 from the angle holding range KA to the angle adjusting range CA, thus smoothly moving the movable plate 60.

The fixed plate 50, the movable plate 60, and the wind direction plates 70 of the wind direction adjustment mechanism 30 are integrally formed. Therefore, the number of components of the wind direction adjustment mechanism 30 can be reduced, so that it is possible to realize a reduction in material costs and a reduction in assembly steps.

In the wind direction adjustment mechanism 30, the angle holding portion 80 includes the flat-plate-like top plate portions 85 at the distal end portion of the side wall portion 81 in the protruding direction, the top plate portions 85 being provided between the partition wall portions 83 and the side wall portion 81. The angle holding portion 80 includes the top plate portions 85 formed into a flat plate shape, so that it is possible to prevent the wind direction adjustment mechanism 30 from disturbing the flow of wind passing through the angle holding portion 80.

In the wind direction adjustment mechanism 30, the angle holding portion 80 has the opening ports 88 that are through holes each of which is formed between the partition wall portion 83 and the side wall portion 81 and through holes each of which is formed between two neighboring partition wall portions 83. The angle holding portion 80 has the opening ports 88 that are through holes formed between the partition wall portions 83 and the side wall portion 81, so that the user can check visually or by touch the position of the holding protrusion 41 of the support plate 40 in the angle holding portion 80.

Each of the plurality of partition wall portions 83 has the groove portion 85*a* on a wall portion on a side opposite to the side where the support plate 40 is disposed. The partition wall portions 83 of the angle holding portion 80 have the groove portions 85*a*, so that the wind direction adjustment mechanism 30 can straighten the flow of air blown from the fan 11 and flowing along the angle holding portion 80 without causing disturbance.

Further, in the wind direction adjustment mechanism 30, each angle adjustment portion 83*a* is formed into a trapezoidal shape in transverse cross section projecting in the direction toward the portion where the support plate 40 is disposed. The angle adjustment portion 83*a* is formed into a trapezoidal shape in transverse cross section projecting in the direction toward the portion where the support plate 40 is disposed and hence, the angle adjustment portion 83*a* serves as a guide for the movable plate 60. Further, when a user moves the movable plate 60 in the left-and-right direction (X axis direction), the movable plate 60 can easily pass over the holding protrusion 41, so that easy manipulation can be realized.

In the wind direction adjustment mechanism 30, the angle restricting portions 83*b* are formed such that as a distance from the center toward either of both end portions of the far side wall portion 81*a* increases in the arrangement direction of the plurality of partition wall portions 83, the protruding length of the angle restricting portion 83*b* increases. Therefore, the holding protrusion 41 of the support plate 40 and the angle restricting portion 83*b* can be caused to come into contact with each other along the moving direction of the movable plate 60 moving arcuately and hence, the wind direction adjustment mechanism 30 can hold the angle of the wind direction plates 70 without fail.

In the wind direction adjustment mechanism 30, each angle restricting portion 83*b* has the distal end portion 83*b*1 positioned at a boundary between the angle adjustment portion 83*a* and the angle restricting portion 83*b*. When the center portion in the width direction of the distal end portion 83*b*1 of one angle restricting portion 83*b* and the center portions of the distal end portions 83*b*1 of the neighboring angle restricting portions 83*b* are connected by an imaginary line, the imaginary line forms an arc shape. Therefore, the holding protrusion 41 of the support plate 40 and the angle restricting portion 83*b* can be caused to come into contact with each other along the moving direction of the movable plate 60 moving arcuately and hence, the wind direction adjustment mechanism 30 can hold the angle of the wind direction plates 70 without fail.

Further, in the wind direction adjustment mechanism 30, the distal end portion 83*b*1 has an inclined surface inclined toward the center portion of the movable plate 60 in the long side direction as viewed in a plan view from the direction perpendicular to the plate surface of the movable plate 60. Therefore, when a user moves the movable plate 60 in a direction from the center toward either of both end portions of the far side wall portion 81*a*, the distal end portion 83*b*1 of the angle restricting portion 83*b* is easily moved along the holding protrusion 41, so that the user can easily manipulate the movable plate 60. Further, the side wall of the angle restricting portion 83*b* disposed at a portion close to the end portion has a larger length than the side wall of the angle restricting portion 83*b* disposed at a portion close to the center and hence, the angle restricting portion 83*b* is prevented from being easily removed from the holding protrusion 41 whereby the angle of the wind direction plates 70 can be held without fail.

In the wind direction adjustment mechanism 30, the angle holding portion 80 includes the ribs 86 each of which is formed in a space between two neighboring partition wall portions 83, and which protrudes from the far side wall portion 81*a* toward the front side wall portion 81*b*. The angle holding portion 80 includes the ribs 86, thus restricting the movement of the movable plate 60 in the front-and-rear direction (Y axis direction) against the holding protrusion 41. Further, the angle holding portion 80 includes the ribs 86, thus ensuring strength of the angle holding portion 80 that comes into contact with the holding protrusion 41.

In the wind direction adjustment mechanism 30, the ribs 86 are formed such that as a distance from the center toward either of both end portions of the far side wall portion 81*a* increases in the arrangement direction of the plurality of partition wall portions 83, the length of the rib 86 in the protruding direction increases. Therefore, the holding protrusion 41 of the support plate 40 and the rib 86 can be caused to come into contact with each other along the moving direction of the movable plate 60 moving arcuately and hence, the wind direction adjustment mechanism 30 can restrict the movement of the movable plate 60 in the front-and-rear direction (Y axis direction) against the holding protrusion 41 without fail.

Each wind direction plate 70 includes the fixed-side columnar portion 71, the movable-side columnar portion 73, and the blade portion 75. The fixed-side columnar portion 71 is fixed to the fixed plate 50, and is elastically deformed by pressure. The movable-side columnar portion 73 is fixed to the movable plate 60, and is elastically deformed by pressure. The blade portion 75 is provided between the fixed-side columnar portion 71 and the movable-side columnar portion 73, and is formed into a flat plate shape. The wind direction plate 70 also includes the fixed-side thin wall portion 76 and the movable-side thin wall portion 77 each of which is formed into a plate shape having a smaller thickness than the blade portion 75, and is elastically deformed by pressure. The fixed-side thin wall portion 76 is formed at a portion where the fixed-side columnar portion 71 and the blade portion 75 are coupled to each other, and the movable-side thin wall portion 77 is formed at a portion where the movable-side columnar portion 73 and the blade portion 75 are coupled to each other. The wind direction plate 70 has such a configuration, thus generating an elastic restoring force based on the movement of the movable plate 60.

In the wind direction adjustment mechanism 30, the support plate 40 includes the fixing portions 42 and the holding portions 43. The fixing portions 42 protrude from the surface portion 40*a*, and engage with the fixed plate 50. Each holding portion 43 protrudes from the surface portion 40*a*, is formed into a hook shape, and slidably holds the movable plate 60. The fixed plate 50 has the fixing-side through holes 52 into which the fixing portions 42 are inserted. The movable plate 60 has the movable-side through holes 61 each of which is formed into an arc shape as viewed in a plan view from the direction perpendicular to the plate surface of the movable plate 60, the holding portions 43 being inserted into the movable-side through holes 61. Therefore, the wind direction adjustment mechanism 30 can fix the fixed plate 50, and can move the movable plate 60. Further, the wind direction adjustment mechanism 30 can move the movable plate 60 arcuately, thus moving the movable plate 60 along the deformation of the wind direction plates 70.

The wind direction adjustment mechanism 30 also has the inner edge portion 61*a* and the outer edge portion 61*b*. The inner edge portion 61*a* forms apart of the movable-side through hole 61, and is disposed at the portion close to the portion where the fixed plate 50 is disposed as viewed in a plan view from the direction perpendicular to the plate surface of the movable plate 60. The outer edge portion 61*b* is disposed at the portion opposite to the portion where the fixed plate 50 is disposed. In the wind direction adjustment mechanism 30, the interval L1 between the inner edge portion 61*a* and the outer edge portion 61*b* is set equal to or greater than the interval L2 between the far side wall portion 81*a* and the front side wall portion 81*b* of the angle holding portion 80. Therefore, the wind direction adjustment mechanism 30 can move the movable plate 60 in the front-and-rear direction (Y axis direction).

The indoor unit 100 of the air-conditioning apparatus also includes the housing 1 and the fan 11. The housing 1 has the air inlet 2 and the air outlet 3. The fan 11 suctions indoor air from the air inlet 2, and blows out conditioned air from the air outlet 3. The indoor unit 100 of the air-conditioning apparatus also includes the heat exchanger 12 and the wind direction adjustment mechanism 30. The heat exchanger 12 is disposed in an air path between the air inlet 2 and the air outlet 3, and causes heat exchange to be performed between refrigerant flowing through the heat exchanger 12 and indoor air suctioned from the air inlet 2. The wind direction adjustment mechanism 30 adjusts blowing direction of conditioned air in the left-and-right direction. The indoor unit 100 of the air-conditioning apparatus includes the wind direction adjustment mechanism 30, so that it is possible to acquire the indoor unit 100 having the advantageous effect obtained by the wind direction adjustment mechanism 30.

Embodiment 2

[Configuration of Air-Conditioning Apparatus 200]

Figure 24:
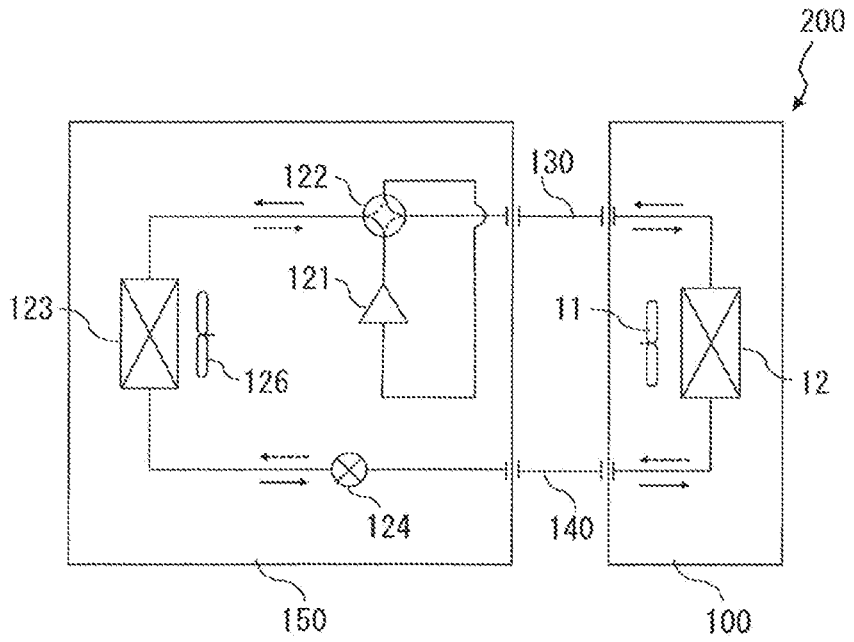
FIG. 24 is a schematic view showing a configuration example of an air-conditioning apparatus according to Embodiment 2 of the present disclosure.

FIG. 24 is a schematic view showing a configuration example of the air-conditioning apparatus 200 according to Embodiment 2 of the present disclosure. The air-conditioning apparatus 200 is an air-conditioning apparatus that uses the indoor unit 100 according to Embodiment 1. Portions having substantially the same configuration as corresponding portions of the indoor unit 100 shown in FIG. 1 to FIG. 23 are given the same symbols, and the description of such portions is omitted. Next, as Embodiment 2 of the present disclosure, the air-conditioning apparatus 200 provided with the indoor unit 100 will be described. In FIG. 24, arrows indicated by solid lines show the flow of refrigerant in the air-conditioning apparatus 200 during a cooling operation, and arrows indicated by dotted lines show the flow of refrigerant in the air-conditioning apparatus 200 during a heating operation. The air-conditioning apparatus 200 shown in FIG. 24 includes an outdoor unit 150 and the indoor unit 100, and the outdoor unit 150 and the indoor unit 100 are connected by pipes made of a refrigerant pipe 130 and a refrigerant pipe 140. In the air-conditioning apparatus 200, a compressor 121, a flow passage switching device 122, a heat exchanger 123, an expansion valve 124, and the heat exchanger 12 are sequentially connected via refrigerant pipes. When the flow of refrigerant is switched using the flow passage switching device 122 of the outdoor unit 150, the air-conditioning apparatus 200 can switch between the heating operation and the cooling operation. The configuration of the air-conditioning apparatus 200 shown in FIG. 24 is merely one example. For example, the air-conditioning apparatus 200 shown in FIG. 24 may be provided with a muffler, an accumulator or other parts.

The indoor unit 100 includes the heat exchanger 12. The heat exchanger 12 causes heat exchange to be performed between refrigerant and air, which is an object to be air-conditioned. The heat exchanger 12 serves as a condenser during the heating operation, so that the heat exchanger 12 condenses and liquefies refrigerant. The heat exchanger 12 serves as an evaporator during the cooling operation, so that the heat exchanger 12 evaporates and vaporizes refrigerant. The fan 11 is disposed at a position in the vicinity of the heat exchanger 12 such that the fan 11 faces the heat exchanger 12.

The outdoor unit 150 includes the compressor 121, the flow passage switching device 122, the heat exchanger 123, and the expansion valve 124. The compressor 121 compresses and discharges suctioned refrigerant. The flow passage switching device 122 is made of a four-way valve, for example, and is a device that switches the direction of the flow passage of refrigerant. The air-conditioning apparatus 200 switches the flow of refrigerant using the flow passage switching device 122, thus realizing the heating operation or the cooling operation. The heat exchanger 123 causes heat exchange to be performed between refrigerant and outdoor air. The heat exchanger 123 serves as an evaporator during the heating operation, so that the heat exchanger 123 evaporates and vaporizes refrigerant. The heat exchanger 123 serves as a condenser during the cooling operation, so that the heat exchanger 123 condenses and liquefy refrigerant. A fan 126 is disposed at a position in the vicinity of the heat exchanger 123 such that the fan 126 faces the heat exchanger 123. The expansion valve 124 is an expansion device (flow rate control unit). The expansion valve 124 adjusts the flow rate of refrigerant flowing through the expansion valve 124, thus serving as an expansion valve that reduces the pressure of refrigerant flowing into the expansion valve 124. When the expansion valve 124 is made of an electronic expansion valve or any of other valves, for example, an opening degree is adjusted based on an instruction of a controller (not shown in the drawing) or the like.

[Example of Action of Air-Conditioning Apparatus 200]

Next, an action during the cooling operation will be described as the example of the action of the air-conditioning apparatus 200. Gas refrigerant having a high temperature and a high pressure is compressed by and discharged from the compressor 121 and, then, the gas refrigerant flows into the heat exchanger 123 via the flow passage switching device 122. The gas refrigerant flowing into the heat exchanger 123 is condensed due to heat exchange with outside air blown by the fan 126, thus forming refrigerant having a low temperature, and flowing out from the heat exchanger 123. The refrigerant flowing out from the heat exchanger 123 is expanded and reduced in pressure by the expansion valve 124, thus forming two-phase gas-liquid refrigerant having a low temperature and a low pressure. This two-phase gas-liquid refrigerant flows into the heat exchanger 12 of the indoor unit 100, and evaporates due to heat exchange with indoor air blown by the fan 11, thus forming gas refrigerant having a low temperature and a low pressure, and flowing out from the heat exchanger 12. At this point of operation, heat of the indoor air is absorbed by refrigerant, so that the indoor air is cooled, thus forming conditioned air (air to be blown out), and this conditioned air is blown out from the air outlet 3 of the indoor unit 100 into a room (air-conditioned space). The gas refrigerant flowing out from the heat exchanger 12 is suctioned by the compressor 121 via the flow passage switching device 122, and is compressed again. The above-mentioned actions are repeated.

Next, the action during the heating operation will be described as the example of the action of the air-conditioning apparatus 200. Gas refrigerant having a high temperature and a high pressure is compressed by and discharged from the compressor 121 and, then, the gas refrigerant flows into the heat exchanger 12 of the indoor unit 100 via the flow passage switching device 122. The gas refrigerant flowing into the heat exchanger 12 is condensed due to heat exchange with indoor air blown by the fan 11, thus forming refrigerant having a low temperature, and flowing out from the heat exchanger 12. At this point of operation, indoor air heated by receiving heat from the gas refrigerant forms conditioned air (air to be blown out), and is blown out from the air outlet 3 of the indoor unit 100 into a room (air-conditioned space). The refrigerant flowing out from the heat exchanger 12 is expanded and reduced in pressure by the expansion valve 124, thus forming two-phase gas-liquid refrigerant having a low temperature and a low pressure. This two-phase gas-liquid refrigerant flows into the heat exchanger 123 of the outdoor unit 150, and evaporates due to heat exchange with outside air blown by the fan 126, thus forming gas refrigerant having a low temperature and a low pressure, and flowing out from the heat exchanger 123. The gas refrigerant flowing out from the heat exchanger 123 is suctioned into the compressor 121 via the flow passage switching device 122, and is compressed again. The above-mentioned actions are repeated.

As described above, the air-conditioning apparatus 200 is provided with the indoor unit 100 according to Embodiment 1, so that it is possible to acquire the air-conditioning apparatus 200 having advantageous effect of Embodiment 1.

Note that the embodiments of the present disclosure are not limited to the above-mentioned embodiments. For example, the fixed plate 50, the movable plate 60, and the wind direction plates 70 of the wind direction adjustment mechanism 30 are integrally formed. The fixed plate 50, the movable plate 60, and the wind direction plates 70 are made of an elastic material. As the modification of the wind direction adjustment mechanism 30, the fixed plate 50, the movable plate 60, and the wind direction plates 70 may be formed as separate parts, and the wind direction plates 70 may be made of an elastic material.

REFERENCE SIGNS LIST

1 housing, 1A front housing, 1B base, 2 air inlet, 3 air outlet, 4 upper surface portion, 5 front surface portion, 6 lower surface portion, 7 vertical flap, 8 air path, 8A air supply path, 11 fan, 12 heat exchanger, 13 drain pit, 14 electric component box, 30 wind direction adjustment mechanism, 40 support plate, 40*a* surface portion, 41 holding protrusion, 41*a* side surface portion, 41*b* top surface portion, 41*c* connecting portion, 42 fixing portion, 42*a* distal end portion, 43 holding portion, 43*a* columnar portion, 43*b* support portion, 44 insertion portion, 44*a* opening port, 50 fixed plate, 50*a* surface portion, 51 protruding end portion, 52 fixing-side through hole, 60 movable plate, 60*a* surface portion, 61 movable-side through hole, 61*a* inner edge portion, 61*b* outer edge portion, 62 graspable expanded portion, 63 graspable protrusion portion, 64 wind direction plate mounting rib, 70 wind direction plate, 71 fixed-side columnar portion, 71A fixed-side distal end portion, 73 movable-side columnar portion, 75 blade portion, 76 fixed-side thin wall portion, 77 movable-side thin wall portion, 80 angle holding portion, 81 side wall portion, 81*a* far side wall portion, 81*b* front side wall portion, 83 partition wall portion, 83*a* angle adjustment portion, 83*b* angle restricting portion, 83*b*1 distal end portion, 85 top plate portion, 85*a* groove portion, 86 rib, 88 opening port, 100 indoor unit, 121 compressor, 122 flow passage switching device, 123 heat exchanger, 124 expansion valve, 126 fan, 130 refrigerant pipe, 140 refrigerant pipe, 150 outdoor unit, 200 air-conditioning apparatus.

The invention claimed is:

1. A wind direction adjustment mechanism disposed in an air supply path connecting a fan and an air outlet, the fan being disposed in an indoor unit of an air-conditioning apparatus, a housing of the indoor unit having the air outlet, the wind direction adjustment mechanism comprising:

a support plate configured to form a part of the air supply path of the indoor unit, and having a holding protrusion protruding from a surface portion of the support plate;

a fixed plate fixed to the surface portion of the support plate;

a movable plate configured to face the surface portion of the support plate, the movable plate being slidably held by the support plate; and a plurality of wind direction plates made of an elastic material, provided to extend between the fixed plate and the movable plate, and protruding in a direction opposite to a direction toward a portion where the support plate is disposed, the plurality of wind direction plates being arranged in parallel, wherein the movable plate includes an angle holding portion into which the holding protrusion is inserted to maintain a sliding position of the movable plate, the angle holding portion includes:

a side wall portion including a far side wall portion and a front side wall portion, and protruding in the direction opposite to the direction toward the portion where the support plate is disposed, thus forming a frame structure, the far side wall portion facing a portion where the fixed plate is disposed, the front side wall portion being disposed on a side opposite to the far side wall portion; and a plurality of partition wall portions configured to couple the far side wall portion and the front side wall portion to each other, the plurality of partition wall portions being formed in parallel, each of the plurality of partition wall portions is formed such that an angle adjustment portion and an angle restricting portion are integrally formed, the angle adjustment portion protruding from the front side wall portion in a direction toward a portion where the far side wall portion is disposed, the angle restricting portion protruding from the far side wall portion in a direction toward a portion where the front side wall portion is disposed, coupling to the angle adjustment portion, and being formed to have a larger wall thickness than the angle adjustment portion in a direction perpendicular to a plate surface of the movable plate, and in a state where the fixed plate and the movable plate are disposed on the support plate, the holding protrusion is disposed in a space surrounded by the plurality of partition wall portions and the side wall portion, and the angle restricting portion comes into contact with the holding protrusion, and, when pushed, the movable plate is biased by the elastic restoring force of the wind direction plates in the direction opposite to the direction toward the portion where the fixed plate is disposed.

2. The wind direction adjustment mechanism of claim 1, wherein the fixed plate, the movable plate, and the plurality of wind direction plates are integrally formed.

3. The wind direction adjustment mechanism of claim 1, wherein the angle holding portion further includes a top plate portion at a distal end of the side wall portion in a protruding direction, the top plate portion being provided between the plurality of partition wall portions and the side wall portion, and having a flat plate shape.

4. The wind direction adjustment mechanism of claim 1, wherein the angle holding portion has an opening port between the side wall portion and one of the plurality of partition wall portions, and between two neighboring partition wall portions out of the plurality of partition wall portions, the opening port being a through hole.

5. The wind direction adjustment mechanism of claim 1, wherein each of the plurality of partition wall portions has a groove portion on a wall portion on a side opposite to a side where the support plate is disposed.

6. The wind direction adjustment mechanism of claim 1, wherein the angle adjustment portion is formed into a trapezoidal shape in transverse cross section projecting in a direction toward the portion where the support plate is disposed.

7. The wind direction adjustment mechanism of claim 1, wherein the angle restricting portions are formed such that as a distance from a center toward either of both end portions of the far side wall portion increases in an arrangement direction of the plurality of partition wall portions, a protruding length of the angle restricting portion increases.

8. The wind direction adjustment mechanism of claim 1, wherein the angle restricting portion has a distal end portion positioned at a boundary between the angle adjustment portion and the angle restricting portion, and when a center portion in a width direction of the distal end portion of one of the angle restricting portions and center portions of distal end portions of neighboring angle restricting portions out of the angle restricting portions are connected by an imaginary line, the imaginary line forms an arc shape.

9. The wind direction adjustment mechanism of claim 8, wherein the distal end portion has an inclined surface inclined toward a center portion of the movable plate in a long side direction as viewed in a plan view from a direction perpendicular to a plate surface of the movable plate.

10. The wind direction adjustment mechanism of claim 1, wherein the angle holding portion further includes a rib formed in a space between the two neighboring partition wall portions, the rib protruding from the far side wall portion toward the front side wall portion.

11. The wind direction adjustment mechanism of claim 10, wherein the ribs are formed such that as a distance from a center toward either of both end portions of the far side wall portion increases in an arrangement direction of the plurality of partition wall portions, a length of the rib in a protruding direction increases.

12. The wind direction adjustment mechanism of claim 1, wherein each of the plurality of wind direction plates includes:

a fixed-side columnar portion fixed to the fixed plate, the fixed-side columnar portion being elastically deformed by pressure;

a movable-side columnar portion fixed to the movable plate, the movable-side columnar portion being elastically deformed by the pressure;

a blade portion provided between the fixed-side columnar portion and the movable-side columnar portion, and formed into a flat plate shape; and a thin wall portion formed at a portion where the fixed-side columnar portion and the blade portion are coupled to each other, having a smaller thickness than the blade portion, and being elastically deformed by the pressure.

13. The wind direction adjustment mechanism of claim 1, wherein the support plate includes:

a fixing portion protruding from the surface portion to be engaged with the fixed plate; and a holding portion protruding from the surface portion, formed into a hook shape, and slidably holding the movable plate, the fixed plate has a fixing-side through hole into which the fixing portion is inserted, and the movable plate has a movable-side through hole formed into an arc shape as viewed in a plan view from the direction perpendicular to the plate surface of the movable plate, the holding portion being inserted into the movable-side through hole.

14. The wind direction adjustment mechanism of claim 13, wherein as viewed in a plan view from the direction perpendicular to the plate surface of the movable plate, an interval between an inner edge portion and an outer edge portion is set to equal to or greater than an interval between the far side wall portion and the front side wall portion of the angle holding portion, the inner edge portion forming a part of the movable-side through hole, and being disposed at a portion close to a portion where the fixed plate is disposed, the outer edge portion being disposed at a portion opposite to the portion where the fixed plate is disposed.

15. An indoor unit of an air-conditioning apparatus, the indoor unit comprising:

a housing having an air inlet and the air outlet;

a fan configured to suction indoor air from the air inlet and configured to blow out conditioned air from the air outlet;

a heat exchanger disposed in an air path between the air inlet and the air outlet, and configured to cause heat exchange to be performed between refrigerant flowing through the heat exchanger and the indoor air suctioned from the air inlet; and the wind direction adjustment mechanism of claim 1.

16. An air-conditioning apparatus provided with the indoor unit of the air-conditioning apparatus of claim 15.

* * * * *